US006486418B1

(12) United States Patent
Jorczak

(10) Patent No.: US 6,486,418 B1
(45) **Date of Patent: *Nov. 26, 2002**

(54) CONTROLLER SWITCH ASSEMBLY

(75) Inventor: Alan D. Jorczak, Ormond Beach, FL (US)

(73) Assignee: Entech Controls Corporation, Ormond Beach, FL (US)

( * ) Notice: Subject to any disclaimer, the term of this patent is extended or adjusted under 35 U.S.C. 154(b) by 135 days.

This patent is subject to a terminal disclaimer.

(21) Appl. No.: 09/636,362

(22) Filed: Aug. 11, 2000

Related U.S. Application Data

(63) Continuation of application No. 09/266,070, filed on Mar. 10, 1999, now Pat. No. 6,130,386.

(51) Int. Cl.[7] ..... H01H 3/00
(52) U.S. Cl. ..... 200/17 R; 200/4
(58) Field of Search ..... 200/562–572, 200/17 R, 4, 314, 316, 579, 78, 16 B

(56) References Cited

U.S. PATENT DOCUMENTS

| | | | |
|---|---|---|---|
| 2,497,414 | A | 2/1950 | Mossman |
| 2,912,530 | A | 11/1959 | Frachon |
| 2,980,825 | A | 4/1961 | Frachon |
| 3,384,727 | A | 5/1968 | Zavertnik et al. |
| 3,949,347 | A | 4/1976 | Gilbreath |
| 4,000,382 | A | 12/1976 | Kolb |
| 4,027,122 | A | 5/1977 | Bevacqua |
| 4,145,586 | A | 3/1979 | Swann |
| 4,164,633 | A | 8/1979 | Sheridan et al. |
| 4,455,458 | A | 6/1984 | Oyama |
| 4,518,832 | A | 5/1985 | Geremia |
| 4,616,115 | A | 10/1986 | Potyka |
| 4,626,699 | A | 12/1986 | Oesterle et al. |

(List continued on next page.)

FOREIGN PATENT DOCUMENTS

| | | |
|---|---|---|
| DE | 23 42 425 | 3/1975 |
| GB | 584764 | 1/1947 |

OTHER PUBLICATIONS

ALSTOM Advertisement. No Date.

Picture of General Railway Signal Switch and Union Switch and Signal Switch. No Date.

Union Switch & Signal Advertisement for Microlok II Wayside Control System. No Date.

Gereral Railway Signal Switch Drawing No. 30731–000–00. No Date.

*Primary Examiner*—Elvin Enad
*Assistant Examiner*—Lisa N Klaus
(74) *Attorney, Agent, or Firm*—Allen, Dyer, Doppelt, Milbrath & Gilchrist, P.A.

(57) ABSTRACT

An electromechanical switch operable with systems for controlling and monitoring vehicular traffic includes switch modules carried within a housing for mounting on a system control panel. Selected switch modules are slidable mounted within pockets and positioned for operation with a shaft that is rotatable and slidable in a push-pull fashion for displacing a preselected module for movement thereof and activation of a switch module button by causing the module to be moved from a neutral position to a button operating position which presses the button against a stop for activation of the switch module. The shaft is suitably mounted for rotation within the housing about a longitudinal axis and is operable for activating the selected switch modules by a pushing/pulling movement and a rotational movement of the shaft by a user for activating one or a combination of switch modules. Alternate switching is provided by alternate switch modules fixed within the housing for activation of their respective buttons by a disk carried on the shaft, which disk includes apertures therein aligned for activating preselected buttons of the alternate switch modules by contact with the disk while having certain buttons of the alternate modules fall within the apertures for avoiding activation thereof.

30 Claims, 18 Drawing Sheets

U.S. PATENT DOCUMENTS

| | | | | |
|---|---|---|---|---|
| 4,724,286 | A | | 2/1988 | Cummins |
| 4,755,638 | A | | 7/1988 | Geberth, Jr. |
| 4,866,219 | A | | 9/1989 | Riding et al. |
| 5,140,111 | A | | 8/1992 | Vultaggio et al. |
| 5,165,530 | A | | 11/1992 | Shinohara et al. |
| 5,264,821 | A | | 11/1993 | Vultaggio et al. |
| 5,491,311 | A | | 2/1996 | Muscat et al. |
| 5,546,067 | A | | 8/1996 | Schmidt et al. |
| 5,817,996 | A | | 10/1998 | Ulrich et al. |
| 5,818,349 | A | | 10/1998 | Dayton |
| 5,823,666 | A | | 10/1998 | Kingsolver |
| 6,130,386 | A | * | 10/2000 | Jorczak ..... 200/17 R |

* cited by examiner

48

CONTROLLER SWITCH ASSEMBLY

CROSS-REFERENCE TO RELATED APPLICATION

This application is a continuation of and hereby incorporates by reference the disclosure of application Ser. No. 09/266,070, filed on Mar. 10, 1999, now U.S. Pat. No. 6,130,386 for "Controller Switch Assembly" which is commonly owned and assigned with the present invention.

FIELD OF THE INVENTION

This invention relates to electromechanical switches, and more particularly, to controls that are primarily used in complex signal systems for monitoring and controlling the flow of vehicular and railroad traffic or industrial processes including electric utilities, petrochemical, water treatment and materials handling systems.

BACKGROUND OF THE INVENTION

Design engineers and manufacturers of both large and small control panels are continually striving to maximize the amount of control function they can provide within the smallest amount of panel space. In addition to the cost savings achieved by using less mechanical equipment and a smaller amount of floor space, higher density control panels allow an operator to view and control more functions for a given amount of space and therefore require fewer personnel to operate.

The majority of traffic flow control systems interface with programmable logic controllers that actually direct traffic flow control situations. Customers are generally not interested in having redundant spare switches in case of a failure. This is because there are now multiple electrical/electronic system driven safety backups should an electrical circuit malfunction for any reason. Also, wiring is both heavy and expensive and duplicate function spare wires consume too much space in panels. Because spare wires also consume connector and terminal block space and the labor to assemble them, wire cables and harnesses to these controller switches carry the fewest number of individual wires necessary for the required signals. Rewiring of connectors or harnesses to access backup switch modes in a controller switch is neither practical nor reliable once a panel is completely installed in the field.

Today, designers are more interested in circuit flexibility and maximizing the number of circuit functions that can be accessed for a given panel space. Design engineers also often prefer to identify certain specific operating motions to circuit activation. Perhaps, as an added safety feature to prevent inadvertent operation, a designer may require an operator to pull or push and then quickly turn a knob before a circuit can operate. Conversely, the designer may require a specific degree of rotation to activate a specific circuit or require a circuit be momentary in one direction of rotation and maintained or latching in the opposite direction of rotation.

OBJECTS AND SUMMARY OF THE INVENTION

It is an object of the invention to provide a switch.

A further object is to provide a switch capable of push only, pull only, push-pull, left turn, right turn, left and right turn, or push-pull left turn right turn combinations of action.

Another object is to provide a switch capable of maintained switch action, momentary switch action, or combinations of both in any switch with multiple positions.

Still another object is to provide a switch which can incorporate multiple means of mounting, multiple means of signal wire termination, an extensive variety of circuit possibilities, and an array of multiple LED illumination capability packaged in the smallest possible controller switch footprint available today.

Yet another object of the invention is to provide a control panel switch which provides for an improvement in panel density and an increase in signal functions per cubic volume of panel space, thereby providing customers with unparalleled cost savings.

In view of the above considerations, the present invention provides a modular family of multi-function high circuit density controls that can realize a range of specific types of circuits and actions that can be easily matched to the needs of particular applications. The invention can be used in a family of controls that can be adapted to a variety of behind panel depth limitations while still providing the maximum number of discrete circuits for a given cubic volume of space. The control density provided by the invention is unmatched by any currently available device or series of devices.

The modular concept of a switch according to the invention is to allow them to be easily replaced in a panel or grid system by removing one nut and disconnecting the plug connector. A new switch can be quickly mounted in the grid or panel, and the malfunction unit can be repaired at a remote site.

A switch according to the invention allows for push only, pull only, push-pull, left turn, right turn, left and right turn, or push-pull left turn right turn combinations of action, with the switch actions being maintained, momentary, or combinations of both in any switch with multiple positions. The Switch incorporates multiple means of mounting, multiple means of signal wire termination, an extensive variety of circuit possibilities, and an array of multiple LED illumination capability packaged in the smallest controller switch footprint available today. The resultant improvement in panel density and signal functions per cubic volume of space provides customers with unparalleled cost savings.

Switches incorporating the present invention are designed around a single unit base structure with a simple "drop-in design" mechanical operating mechanism that allows for interchangeable mounting bushings and operating shafts of various lengths for different panel or grid/title thickness'. All switches feature either cable or connector control wire termination and the "drop-in" electrical switching contact elements can be varied to customize individual control circuit requirements. The design provides for simple, but unique, precise operating shaft and control surface stops to insure that millions of operating cycles will be possible under severe field conditions.

By incorporating all of the push/pull/turn forms of action into a primary internal shaft support bearing the overall length of the control is reduced while a higher level of protection from the elements is achieved. That is, external control open areas which allow dust and dirt to enter moving parts are eliminated by encapsulating the shaft and its associated switch modules within a common enclosure.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION

Figure 1:
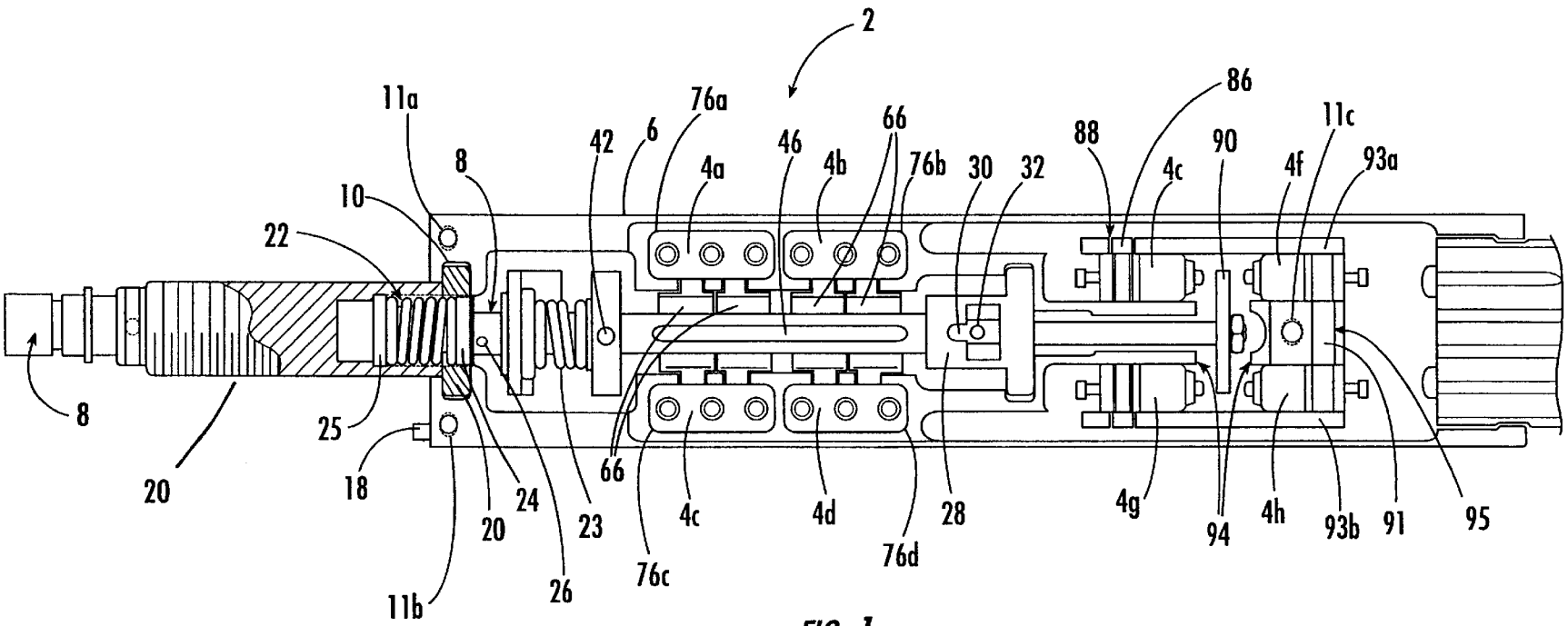
FIG. 1 is a top plan view of one switch assembly of the present invention illustrated in an open arrangement.

A family of push, pull, push-pull, left turn only, right turn only, left and right turn, push turn, pull turn and push-pull turn switches as herein described, accept from 1 to 14 (but expandable to more) Form C (one normally open, one normally closed) switching modules from a variety of different manufacturers. The switch actions can be maintained, momentary, or combinations of both in any switch with multiple positions.

A preferred embodiment of a switch assembly 2 of the present invention includes a rectangular housing 6 accessible by removal of a lid 13 currently attached with 3 screws (longer versions may require two additional lid screws). The housing 6 can be machined, molded or die cast and is designed to accept a variety of different diameter and length bushings at one end and a variety of wiring means at the other end with connectors, individual wires or cable sets being the most popular interfaces. The housings 6 are consistent in overall rectangular face panel size and, for the same number of circuits, are 30% smaller in volume than any other switch assembly being sold. The housings 6 will accept a main one piece operating shaft 8 located on both horizontal and vertical centers and running longitudinally approximately ¾ of the length of the housing. The operating shaft 8 will operate in rotational and/or longitudinal directional modes with either maintained (latching) or momentary shaft 8 positions. Movement of the shaft 8 with its integral key, attached disks, or both items will actuate a single or multiple drop-in switch module elements in a precise fashion. Operation of some of the drop-in switch module elements through their direct movement and rotation of the mounting position of other modules to permit variation in switch operating actions, provides unique design elements allowing for a significantly wider array of circuits and operating actions. The inclusion of a modular single or multi-LED illumination system for a variety of panel thickness' or grid and tile mount systems results in panel density space savings of up to 50%. The unique LED illumination system easily mounts to switch controllers and is adjustable for switches mounted on a variety of different thickness panels. The same unique LED system is also designed to mount to grid and tile systems of different thickness or different size and type tiles, thereby supplying a universally mountable family of products. Therefore, the end users (railroads, electric utilities, etc.) of these control panels now have the ability to select from a variety of competitive panel builders without having to sacrifice on overall panel size for a given area of control density.

The present invention allows for controller switches (without indicators) to be stacked on 0.630" vertical centers and 0.950" horizontal centers providing an unequaled panel density of this type of control in the industry. In addition, in the case of controllers supplied with up to 3 LED indicators, the density is 0.950" on center enabling designers of grid and tile systems to achieve as much as a 50% reduction in panel space as all other 24 mm to 25 mm grid and tile systems marketed require illumination indicators that use a completely separate tile space in the grid structure.

Another advantage of the present invention is that the basic design allows for easy repair of controller switches installed in the field should a switch element fail mechanically or electrically. The all drop-in components are housed within an enclosure with a lid. The simple removal of the three screws holding the lid in place will provide access to the mechanism and the malfunctioning switch element can be easily replaced. In many other designs, the switch contacts or elements are permanently assembled and the control must be scraped if there is a failure of any circuit. For customers that do their own routine maintenance on large control systems, this is a significant advantage. They can maintain a much smaller and less costly inventory as only switch modules need to be stocked. These switch units are compact and are only a small fraction of the cost of a full controller switch assembly.

FIG. 1 is a plan view of a switch assembly 2 in accordance with the present invention. The switch assembly 2 includes eight switching modules 4*a*–4*h* which are within an enclosure including a one-piece compact housing 6 and are actuated by a shaft 8. Of course, the number of switching modules 4 that may be included in the assembly 2 is a design choice that will be discussed in more detail below.

Figure 2:
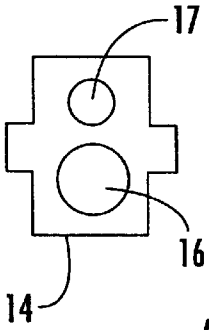
FIG. 2 shows a grid plate suitable for use with a switch assembly in accordance with the invention.
Figure 2A:
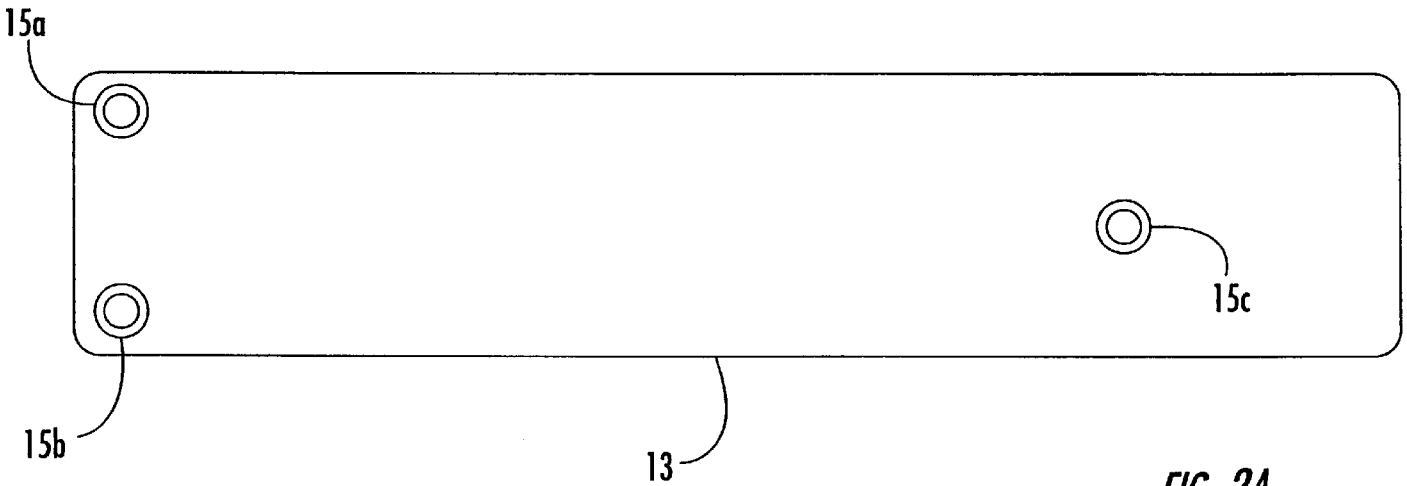
FIGS. 2A and 2B illustrate top and side views of a lid suitable for the assembly of FIG. 1.
Figure 2B:
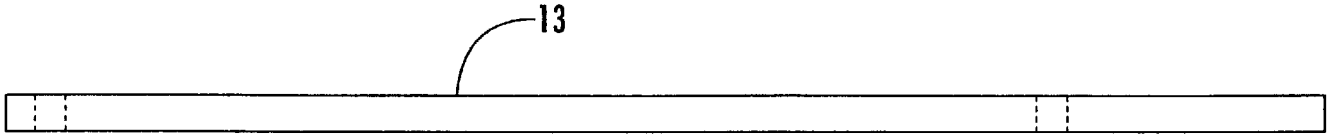

The enclosure includes a lid 13 which is not shown in FIG. 1 for purposes of clarity. FIG. 2A shows top and side views of the lid 13 suitable for attaching to the housing 6 as illustrated with reference again to FIG. 1. As shown in FIG. 2A, the lid 13 preferably includes three through holes 15*a*, 15*b* and 15*c* to accommodate screws for fastening the lid 13 to the housing 6 of FIG. 1 via cover retaining screw points 11*a*, 11*b* and 11*c*.

Figure 1A:
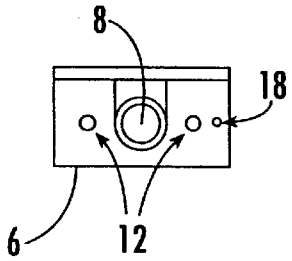
FIG. 1A is a front view of the switch assembly depicted in FIG. 1.

The compact housing 6 is designed to minimize the vertical, horizontal and depth profile of the assembly 2, thereby permitting high density stacking of multiple assemblies and allowing for control of all critical dimensions regarding parts alignment via one part of the assembly 2. The front of the housing 6 is designed with an alignment slot 10 to provide for easy loading of any number of mounting bushings 20 of variable lengths or diameters. This provides the ability to easily mount the switch assembly 2 in a variety of different panel types and thickness' with only two simple changes in parts (the bushing style and shaft diameter and length). As seen in FIG. 1A, two opposing screw holes 12 in the face of the housing 6 placed along a center line of the bushing/shaft 20/8 allow for mounting with various designs of grid plates that will permit easy indexing of the switch assembly 2 to a particular style of grid. One style of grid plate 14 is shown in FIG. 2. The grid plate 14 lies in a plane parallel to the face of the housing 6, and includes a through hole 16 for the shaft 8 and a hole 17 for an LED indicator (to be described below).

When mounting in a panel other than a grid, an index anti-turn locating pin 18 (FIGS. 1 and 1A) is supplied at the 90° position to keep the switch assembly 2 from rotating after installation in the panel. Although the anti-turn pin 18 is shown to be positioned at 90° in the figures, it should be noted that the pin may be located at other locations on the face of the switch assembly 2. In any event, two screws from the underside of the housing (not shown) secure the bushing 20 square to the housing 6 to provide perfect front alignment of the main one piece operating shaft 8. All front bushings 20 have been designed to house the push-pull return compression spring 22 in such a fashion as to maximize compaction of the switch length and provide for an accurate alignment of the front main shaft bearing. The rear surface of the slot 10 has also been designed to act as the rear compression spring seat 24 retainer 24 allowing the seat to remain stationary while the shaft is pushed through the rear seat. This allows the compression spring 22 to compress ("load") and it will then return the shaft 8 to a neutral position 3 when the shaft is released.

The C-ring 26 behind the spring seat 24 was designed to hold the compression spring 22 in a loaded (partially compressed) state in the proper place to permit assembly of the shaft components carried by the shaft 8 prior to their being "dropped in" to the housing 6. The C-ring 26 has been designed to clear the housing 6 and retain the rear spring seat as it travels with the shaft when the shaft is pulled. This permits the rear seat to slide on the shaft 8, compressing the main compression spring 22 in the pull mode loading it to a point that it will force the shaft fully back to the neutral position 3 when the shaft is released. As can be seen from FIG. 1, a front spring seat retainer 25 is also provided and is held in position by an undercut in the diameter of the shaft 8.

The design of the moving action of these components is such that the enclosed and protected spring seats also act as bearings within the bushing 20, aligning the spring forces precisely relative to the shaft 8. The tight tolerances between the bushing bore and spring seat diameters seal the spring 22 from dirt and other contaminants that can reduce operating life and promote sticking problems that would inhibit the shaft 8 from returning to the neutral position from the push or pull mode as illustrated by way of example with reference again to FIG. 1. This insures a more durable structure that will extend mechanical life significantly over other compression spring designs that allow much greater exposure of the compression spring to elements in the air.

Figure 10:
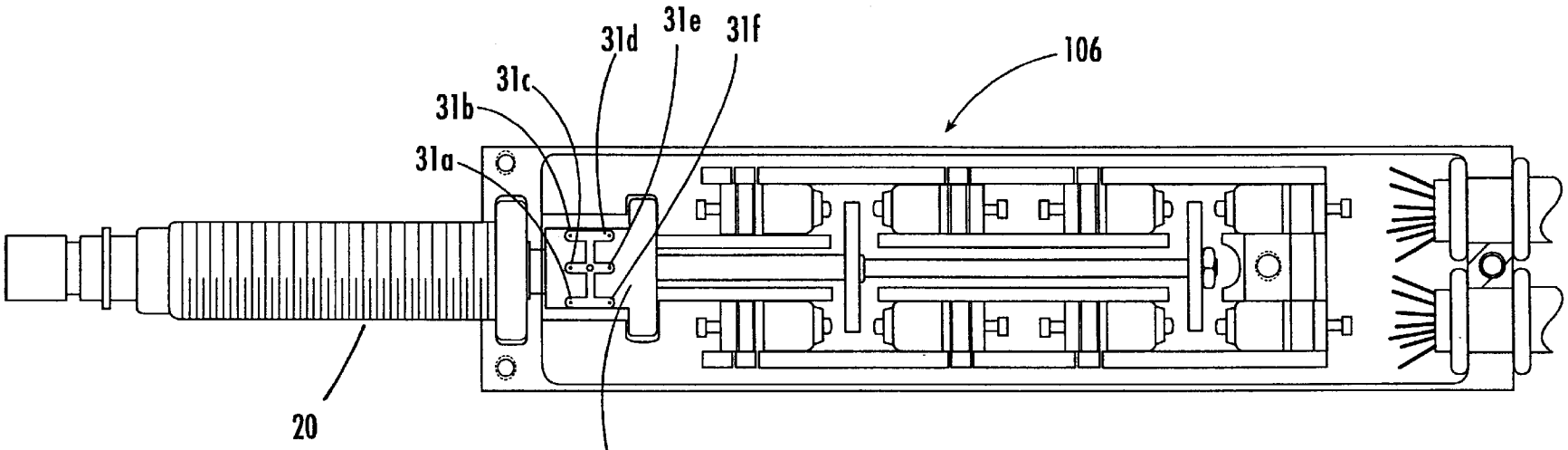
FIG. 10 is a plan view of an 8 switch module push-pull switch assembly according to the invention.

The rear shaft bearing 28 also "drops in" and has two screws (not shown) from the underside of the housing 6 that secure this rear bearing 28 square to both the base of the housing and the front bearing. This design allows for nearly perfect alignment of the two shaft bearing points enabling precise control of shaft motion without binding and minimizing wear at the interface points on the shaft 8 and bearings. The alignment facilitates operating both the push-pull and turn motions of the main operating shaft 8 over millions of cycles with little mechanical wear. The rear shaft bearing 28 has been designed to allow incorporation of a series of slots or channels, such as slot 30 (see also slots 31*a*–31*f* in FIG. 10), to provide for or restrict various motions or actions of the switch assembly 2 when a pin is inserted into the shaft 8 in a preselected location to mate with the slots. A partial list of possible slot geometry's along with brief descriptions is provided in Table I.

Incorporating the slot 30 feature directly into a critical main bearing, the rear shaft bearing 28, is unique. Housing this critical shaft control feature within a sealed enclosure, the lid 13 and housing 8, also protects the contents thereof from contaminants like dust and dirt which are prevalent especially in wayside railroad control applications. To date, designs presently known in the art do not provide for the ability to easily tailor a variety of control motions and/or actions to customer needs.

The rear bearing 28 also acts with the shaft/slot pin 32 as a tertiary redundant mechanical stop to the switch push action by preventing any damage to internal switches 4*a*–4*h* operated by this shaft motion due to operator over-stressing the operating switch assembly 2. This bearing slot/pin design also serves as a secondary safety stop to the pull action and the right and left turn actions. While the slot 30 configurations include those shown in Table I, other configurations not shown could be established within this bearing 28 depending upon customer requests for specific shaft motions. The slots and detents in the slots provide points to "latch" the switch assembly 2 in a particular position. The main compression spring 22 in the front bearing/bushing provides the pre-load thus enabling the index pin 32 to engage the detent with sufficient force to overcome the rotational force of the torsion spring 23 that returns the shaft to the neutral position from either the left or right turn modes.

Figure 3A:
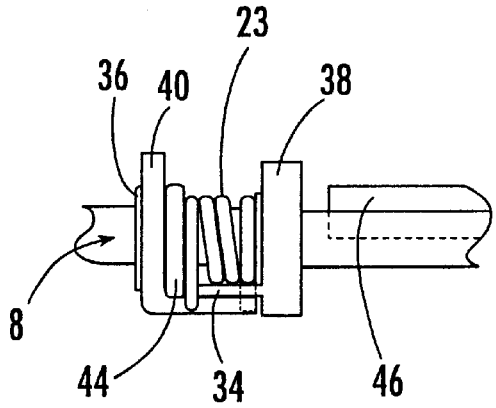
FIGS. 3A and 3B include detailed illustrations of the torsion spring sub-assembly of the switch assembly depicted in FIG. 1 as the sub-assembly is viewed from two perspectives.
Figure 3B:
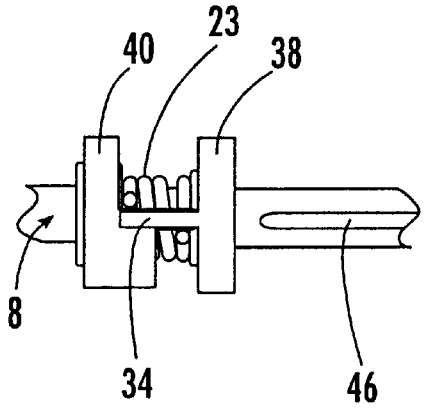

FIGS. 3A and 3B provide a more detailed illustration of the torsion spring 23 sub-assembly. As can be seen from FIGS. 3A and 3B, the left and right turn torsion spring 23 used to return the shaft 8 to the neutral position, as illustrated with reference again to FIG. 1, has a unique sliding shoe 40 to hold it in place and supply the proper pre-load to the spring 23. This shoe 40 eliminates the wear on the inside ends of this spring 23 inherent in other designs due to rubbing of the spring edge on the pin 34 that provides the stop surface and holding point for the ends of the torsion spring during the push-pull cycles on the switch main shaft 8. This unique shoe 40, spacers 44 and collar 38 assembly allow the spring ends to remain fixed during the linear motion of the shaft 8 with the shoe absorbing any linear travel wear. The effect of this design greatly extends spring life and reduces the possibility of spring end fracture which would result in loss of the clockwise or counter-clockwise rotational spring return function. The shoe 40 position on the shaft 8 is fixed by a retaining C-ring 36 on one end and the position of the collar 38 on the other end. The spacers and washers provide proper compression and alignment of the torsion spring 23 to insure the spring ends engage the shoe 40 at right angles. This maximizes the return spring tension and extends the life of this spring 23 to its designed life.

The shoe 40 is also designed to allow from 0°+/– to 110° of rotation from either side of the center neutral (0°) position. The design of the torsion spring 23 assembly consists of a collar 38 with a stainless steel groove pin 34 pressed into it. The pin 34 will rotate either end of the torsion spring (depending on which way the shaft is rotated) while the other end is held stationary by the shoe 40. This eliminates any sliding wear on the spring end edges. The collar 38 was designed to be fixed to the shaft 8 with either a set screw or pin 42 (FIG. 1). A spring spacer 44 slides over the shaft 8 and controls the distance between the shoe 40 and the collar 38. Washer spring seats at both ends of the spacer 44 along with the spacer provide precise positioning of the torsion spring 23 throughout its rotation cycles while minimizing the drag friction of the spring on the spring return function of this assembly 2. One effect of the design of this portion of the switch assembly 2 is that the rotational spring return life is extended to millions of mechanical cycles, enhancing the overall switch performance over other designs known in the art.

Integrated into the shaft is a unique long key 46 (FIGS. 1 and 3) that is used to drive the unique inserts that operate the switch modules in either the right or left turn positions. This single key 46 will operate both the right (4*c*, 4*d*) and left (4*a*, 4*b*) turn position switch modules 4 in either the push or pull shaft positions throughout the total linear travel of the main shaft 8.

Figures 4, 4A, 4B:
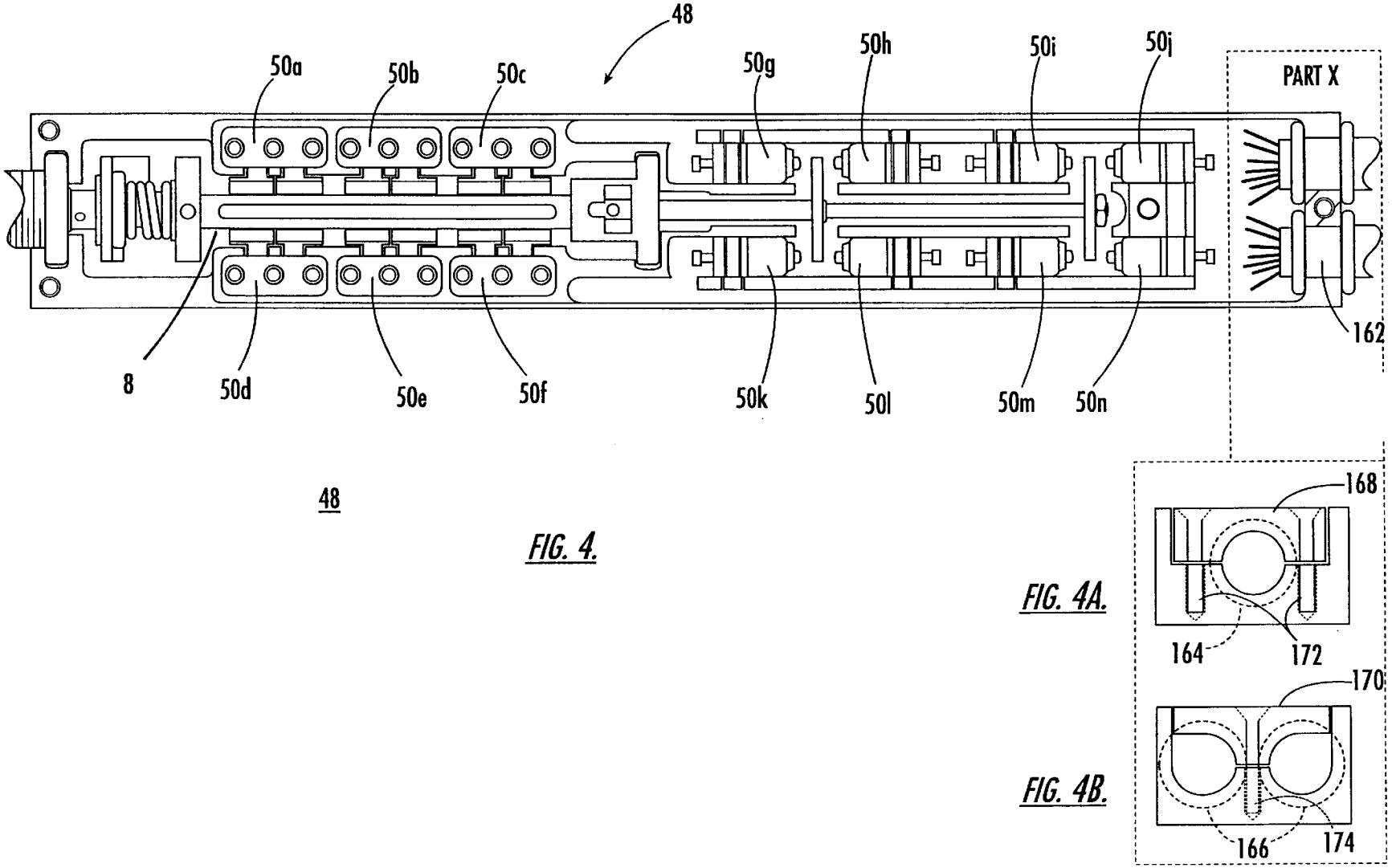
FIG. 4 is a plan view of a 14 module switch assembly in accordance with the invention.
FIGS. 4A and 4B illustrate single and double clamps in exploded views, respectively.

Additional or fewer circuits could be added or subtracted simply by extending or reducing the length of the housing 6 and shaft 8 by adding or reducing the number of switch pockets provided and extending or reducing the key length. The number of circuits provided can also be easily altered by adding or eliminating switches within a specific enclosure design. The housing 6, as illustrated by way of example with reference to FIG. 1, accepts up to two (2) independent Form C switch contact modules 4 in the left turn position 4*a*, 4*b* and two (2) independent switch contact modules 4 in the right turn position 4*c*, 4*d*. It also has two (2) independent modules 4 for the push function 4*f*, 4*h* and two (2) independent modules 4 for the pull function 4*e*, 4*g*. This specific housing will accept up to eight (8) modules each being a Form C contact arrangement, by way of example and convenience of description. An example of a switch assembly 48 having 14 switch modules 50*a*–50*n* is shown in FIG. 4. Switch assembly 48 has three (3) independent Form C switch contact modules 50*a*, 50*b*, 50*c* in the left turn position and three (3) independent modules 50*d*, 50*e*, 50*f* in the right turn position. It also has four (4) independent modules, 50*h*, 50*j*, 50*l*, 50*n* for the push function and four (4) independent modules 50*g*, 50*i*, 50*k*, 50*m* for the pull function.

Figure 5:
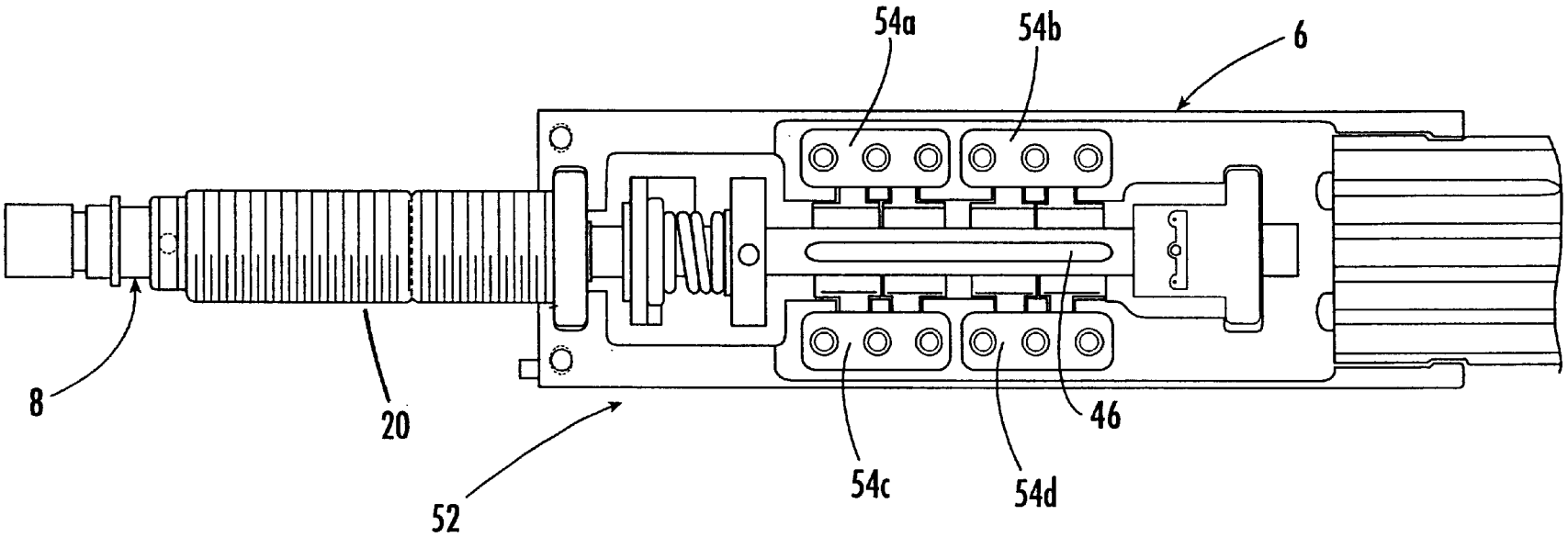
FIG. 5 is a plan view of a 4 module rotation switch assembly in accordance with the invention.
Figure 6:
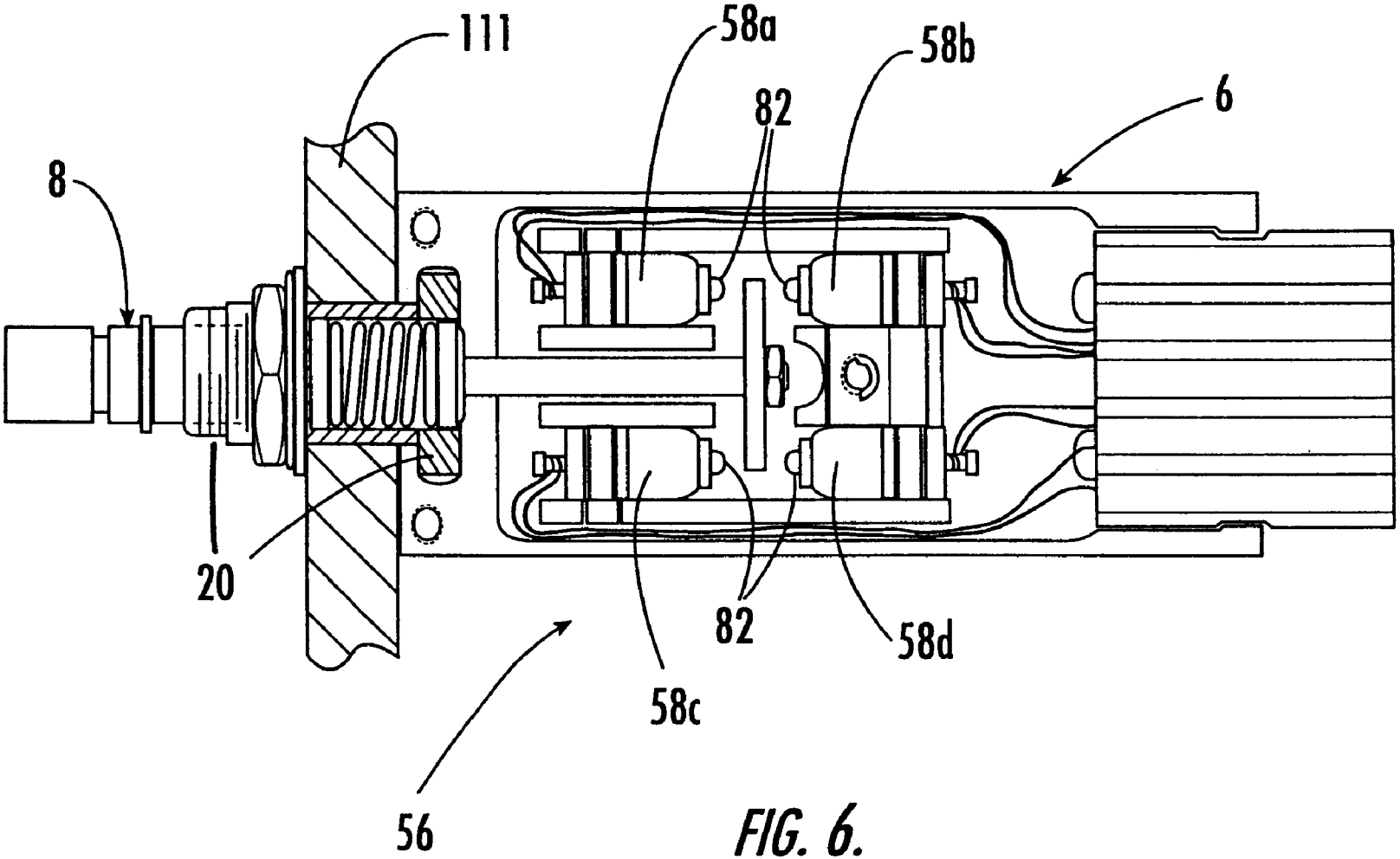
FIG. 6 is a plan view of a 4 module push-pull switch assembly in accordance with the invention.

Examples of switch assemblies having four switch modules are shown in FIGS. 5 and 6. Switch assembly 52 of FIG. 5 has two independent switch modules 54*a*, 54*b* in the left turn position and two independent modules 54*c*, 54*d* in the right turn position. Switch assembly 56 of FIG. 6 has two independent switch modules 58*b*, 58*d* in the push position and two independent modules 58*a*, 58*c* in the pull position. Several views of Form C contact are shown in FIG. 7, parts A and B. The contact has three (3) terminals: one terminal is a common contact 60 that can open or close, a second terminal (contact) 62 that is normally open, and a third terminal (contact) 64 that is normally closed. Besides wiring to the common terminal, wiring to either or both of the other terminals allows for great flexibility in specific circuits being activated in different switch shaft positions.

One preferred embodiment of the present invention, herein described, includes drivers 66 that are inserted in left-right turn switch modules. Profiles of two types of drivers 66, 70 which may be used with the invention are depicted in FIG. 7, Part C.

Driver 66 has a shelf 68 suitable to allow for 90° shaft rotation. Driver 70 has a shelf 72 suitable to allow for 45° shaft rotation. A simple alteration in the position of the shelf 68, 72 on the driver 66, 70 that interfaces with the long key 46 within the shaft 8 will activate these modules at any degree of rotation of the shaft from 20° to 110° of rotation either side of center 0°. Also note the drivers have been designed with flat surfaces 74 (Part A) on their adjacent sides. This minimizes rotation of these parts after assembly in the switch module 4 insuring that they will self align during engagement of the long key 46. This insures a more uniform transmittal of rotary to linear forces which aids in driving both switches (4*a*, 4*b*, by way of example with reference again to FIG. 1) on each side at the same time. Such an arrangement also minimizes the friction generated between the snap switch module case side and the pocket walls. A corresponding unique feature of this design is the ability to easily supply a different degree of rotation either side of the center position. For example, the rotation to the left could be 45° while the rotation to the right was 90°. The advantage to users is that it enables them to have greater flexibility in coding many different degrees of rotation to different control output functions as may be desired. After assembly to the switch module and insertion of the module 4 in the pocket 76, the drivers 66, 70 are held in position by the main shaft 8. The entire control of the switch assembly 2 can be mounted in any rotational position in the panel without affecting its mechanical operation.

These unique drivers 66, 70 effectively transfer rotary motion into linear motion. As shown in FIG. 1, modules 4*a*–4*d* are slidably mounted within pockets 76*a*–76*d* which are formed as an integral part of the housing 6. No other types of controls that employ these precision snap switch modules 4 actually move the entire switch to activate them. Because the snap switch modules 4 require precise travel ranges for their operating button 82, in the prior art modules are typically fixed in rigid positions usually on posts, pins, rivets, eyelets, or screws when mounted in their respective frame assemblies. A cam is then typically used to operate the button within prescribed limits.

Allowing these switch modules 4 to float would normally present major problems in operating these switches without damage to their mechanisms. The constant operation of the button 82 to its maximum travel point or beyond would either cause them to totally fail due to button or internal switch module spring breakage or would significantly reduce their mechanical operating life due to overstressing the switching module 4. However, the present invention including the switch module retaining pockets 76 in the embodiment herein described, prevents this from happening. Means to control the amount of movement of the switch modules 4 activated by the long key 46 during shaft rotation is provided. The drivers 66, 70 are designed to bottom out in the slots 78 (FIG. 7, Part A) in the inside walls of the pockets 76, absorbing the primary force of the rotational pressure. In addition, the bottom of the pocket 76 has been designed as a second safety backup stop. The external case of the switch module 4 will bottom out on raised portion of the pocket floor 80 before the module operating button 82 exceeds its travel limits.

Also, as mentioned earlier, the third button-over-travel backup is supplied by the index pin 32 in the main shaft 8 that travels in the slots 30 in the rear shaft bearing 28. This pin 32 stops the rotational movement by engaging the slot wall before the operating button 82 on the module 4 reaches its maximum travel.

The switch assembly 2 allows the internal module button spring forces in the switch modules 4 to return each left and right switch module (4*a*, 4*b*, and 4*c*, 4*d*) to their neutral position 3 once the main shaft 8 is released from a turn mode. A depressed button 82 unloads, pushing the module 4 until the button reaches an unloaded state. Because the button 82 in the switch module 4 is off-set from center of the module 4, the addition of a second compression spring 84 (FIG. 7, Part A) in the bottom of the pockets 76 provides a counter balance force to the switch module 4. This reduces the possibility of a module 4 cocking during its travel, facilitates smoother module movement, and minimizes mechanical wear between the switch module case and pocket side walls. While this second compression spring 84 is designed to match the forces of the switch button 82 in this specific switch module 4, by increasing or reducing the depth of this pocket 76, spring forces can be easily adjusted to match snap switch module button forces of a number of different manufacturers of these devices. This counter balance of spring 84 will also return the module 4 to its at rest state should the switch module internal button spring fail for any reason.

The pull snap switch modules 4*e*–4*h* have special mounting pins 86 (FIG. 7, Part B) inserted into the module mounting holes. These pins drop into press-fit slots 88 (FIG. 1) in the housing 6, retaining the modules 4*e*–4*h* in the desired location to insure their operating buttons 82 engage the operating disk 90 (FIG. 1) secured to the main shaft 8. These switching modules 4*e*–4*h* do not move and are supported by walls on both sides. Because the heads of the mounting pins have an interference fit to the slot walls, they can't fall out of the switch modules.

Figure 7A:
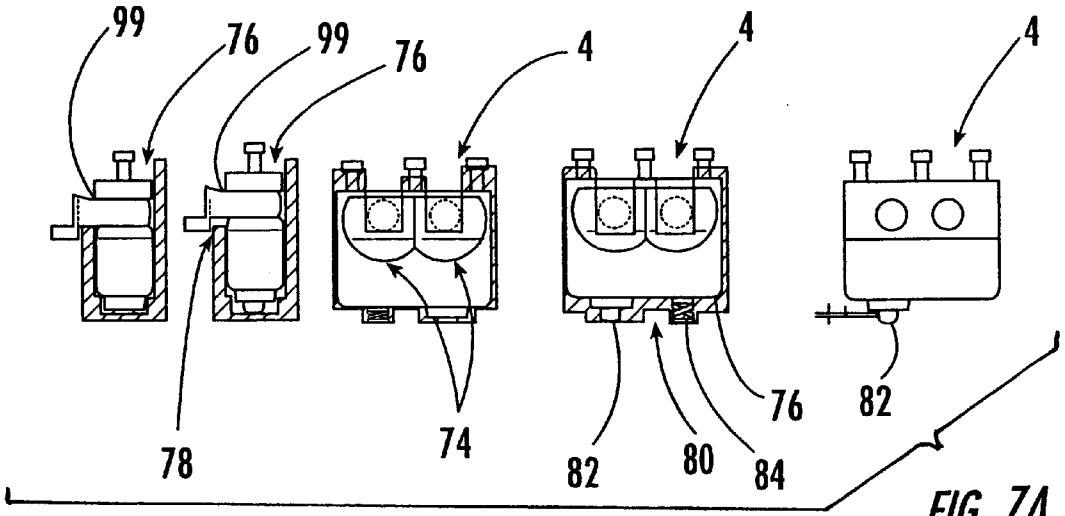
FIGS. 7A, 7B, and 7C illustrate several views of switch modules and switch module drivers which are suitable for use with the invention.
Figure 7B:
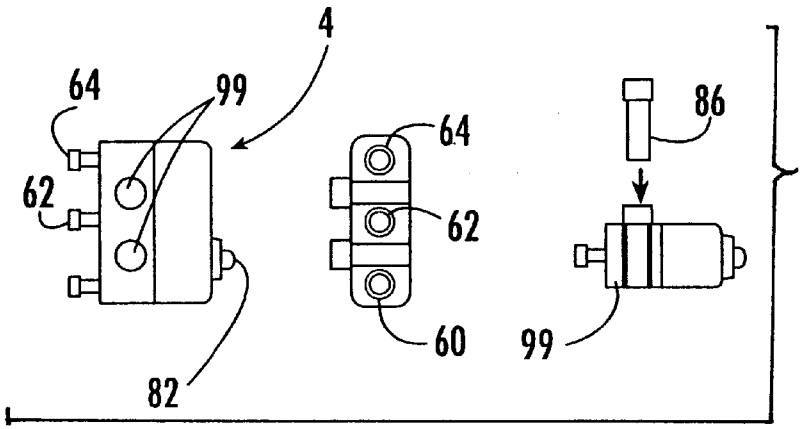
Figure 7C:
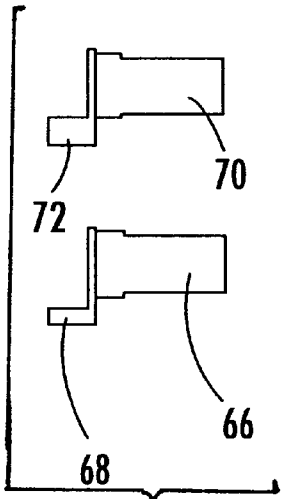
Figure 7D:
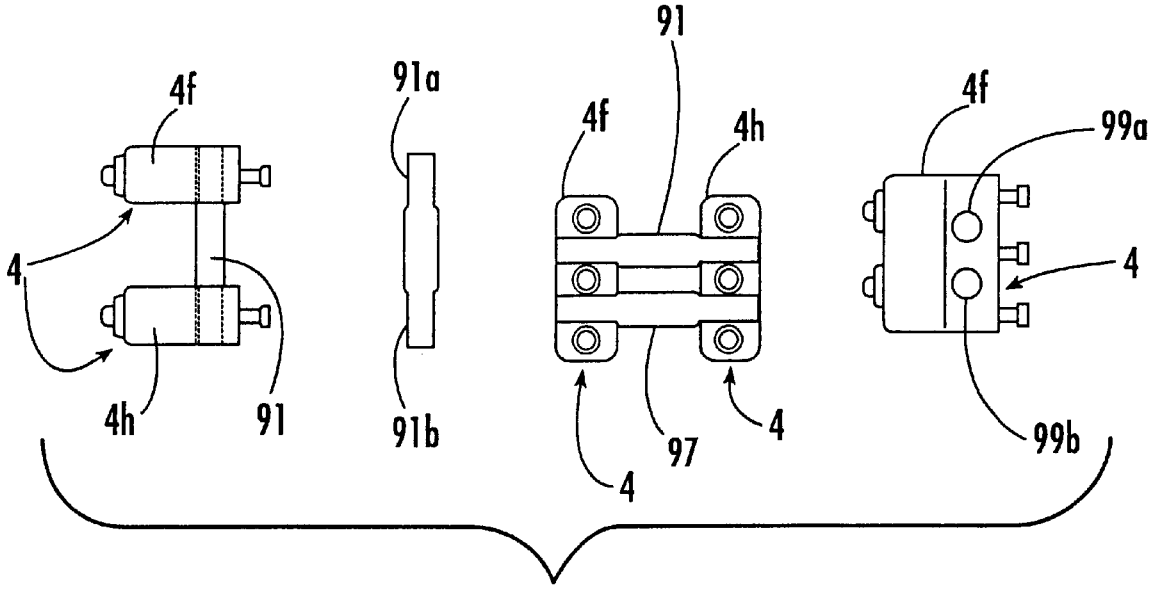
FIG. 7D includes several views of push switch modules and pins according to the invention for the purpose of showing how the push modules and pins are integrated into the invention's switch assembly.

The pins 91 used to nest the push switch modules (e.g. pin 91 of FIG. 1) are sized to fit between interior enclosure walls (e.g. walls 93*a* and 93*b* of FIG. 1) of the switch assembly housing 6 and have an interference fit in a rear cover point mounting slot (e.g. slot 95 of FIG. 1), of the assembly. FIG. 7A includes several views of push switch modules and pins for the purpose of showing how the push modules and pins are integrated into the assembly. Switch modules 4*f* and 4*h* and pin 91 of FIG. 1 are reproduced in FIG. 7A view A. As can be see from view B, pin 91 includes reduced diameters 91*a*, and 91*b* on both of its ends, the reduced diameters being sized so as to fit into the mounting holes of switch modules 4*f* and 4*h*. In a preferred embodiment shown in view C, an additional pin 97 is used to more securely anchor the modules. In view D, a side view of switch 4*f* by way of example is provided to show exemplary mounting holes 99*a* and 99*b* for pins 91 and 97. With the switching modules 4*f*, 4*h* properly positioned in a horizontal plane, the pins can easily be inserted into the slot, providing exact positioning of the push switch module operating buttons. Should one of the push switch modules 4*f* be eliminated, the position of the one module 4*h* on the other side (e.g., 4*f* v. 4*h*) will not change as the pins 91 are of sufficient length to engage the enclosure (93*a*, 93*b*) walls on the other side before coming free from the mounting holes in the other switch module.

Figure 8:
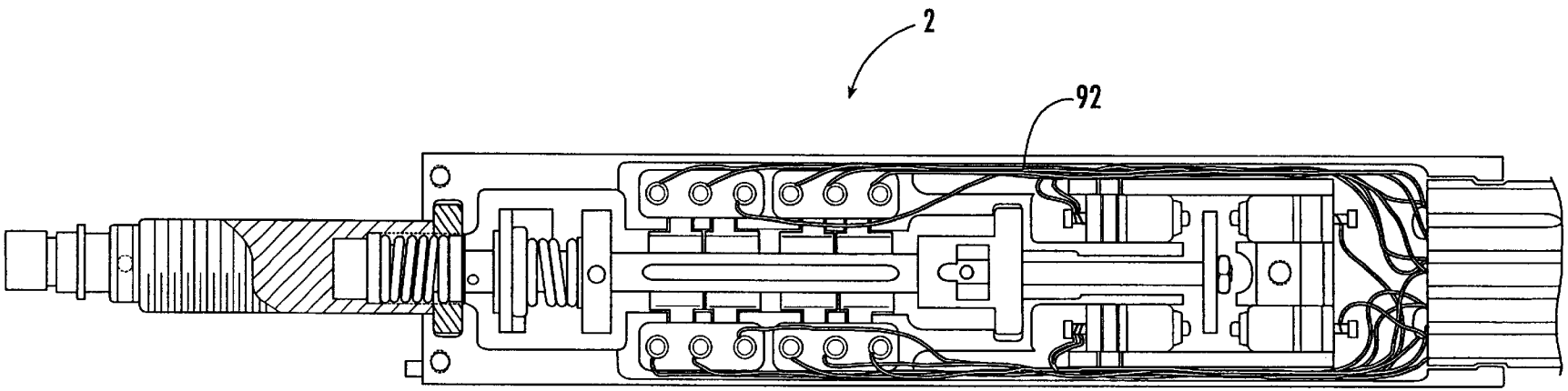
FIG. 8 is a plan view of the switch assembly of FIG. 1 in which the wiring associated with the switch modules is shown.

The lid 13 (FIG. 2A) provides an additional retention of all switch modules 4. In addition, circuit wires 92 (FIG. 8) passing through channels along the inside walls of the housing 6 will inhibit any outward motion of the pins 91, securing the pull switch modules 4*e*–4*h*. The position of the slots in the housing 6 that accept these pin heads is critical to proper positioning of the modules. Their position is timed to the total pull stroke to insure the buttons on the snap switch modules operate within their design parameters. The primary stop control to prevent overdriving these module buttons 82 is the button operating disk 90 or disks mounted along or on the rear of the main shaft 8. As a primary safety stop, this disk 90 is designed to bottom out on internal housing walls 94 (FIG. 1) and supports prior to reaching a position that will bottom out the buttons in the push or pull modes. A second safety stop to the pull motion of the main shaft 8 is the index/slot pin 32 in the slot 30 in the rear main shaft bearing 28. It will bottom out in the slot 30 it travels in before the push switch module button 82 exceeds its travel limits for 4*e*–4*h*.

Figure 9A:
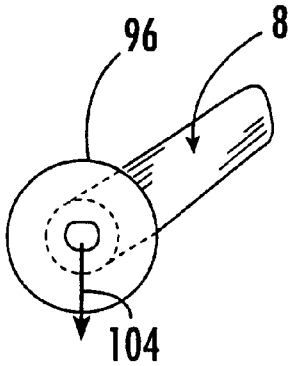
FIGS. 9*a*–9*e* show several operating disks which may be used in the switch assemblies of the invention.
Figure 9B:
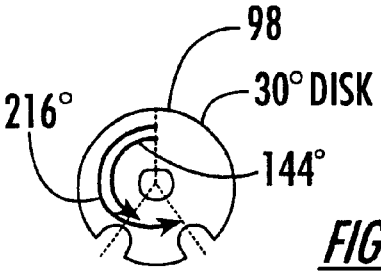
Figure 9C:
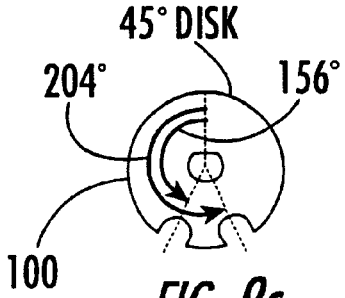
Figure 9D:
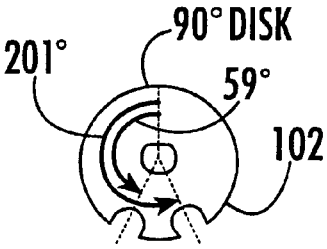
Figure 9E:
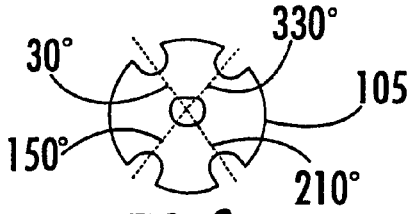

The unique operating disks 90 can be supplied with no breaks in their circumference. These disks 90 will operate all push-pull switch modules 4*e*–4*h* when the main shaft 8 is operated in the center or any left-right turn position of any degree angle of rotation. Conversely, by selectively removing small portions of the circumference of the disks 90 at specific locations on the perimeter of the disks, selective push-pull circuits can be activated or not activated at specific degrees of rotation of the main shaft. Some representative disks 90 are shown in FIGS. 9*a*–9*e*. Referring to FIG. 9*a*, disk 96 is a non-indexing disk, FIG. 9*b* disk 98 is a 30° disk, FIG. 9*c* disk 100 is a 45° disk, FIG. 9*d* disk 102 is a 90° disk and FIG. 9*e* disk 105 is an alternate 30° disk. Arrow 104 is indicative of the rotary position of the shaft 8 and points to the bottom of the assembly enclosure when the shaft 8 is in the neutral position.

Additional flexibility of circuit selection is possible because the present invention permits mounting of the push-pull switch modules 4*e*–4*h* in their respective slot positions with the module operating buttons 82 either up or down. This provides a variety of combinations of which push-pull switches selectively operate at various degrees of left-right main shaft rotation. The practical advantage of being able to mix and match specific switch module operation to different degrees of shaft rotation is that it allows the system circuit designer a much greater latitude when designing system control functions. With this design, the designer can now provide a much higher density of control function per square area within an envelope of panel space than can be obtained with switches of other designs.

This basic design intentionally provided for linear separation of the left-right turn functions from the push-pull functions. This would enable shortening the length of the housing 6 for switch assembly 56 to eliminate either the push-pull switch modules 58*a*–58*d*, as illustrated with reference to FIGS. 5 and 6 of the left-right turn switch modules 54*a*–54*d* (see FIG. 6) when supplying only the push-pull version of switch assembly 56 on the shorter housing 6, as illustrated with reference to FIGS. 5 and 6. Both bearing points for the main shaft are located in the front drop-in bushing when building the shorter enclosure version of this family. In the case of an 8 switch module push-pull device (assembly 106, FIG. 10), a second drop-in rear bearing 108 is provided.

Referring now to FIGS. 11A–11D, the LED illumination aspects of the invention will be discussed. The methods of LED illumination for the variety of panel types and thickness', or grid and tile systems available, required a new but flexible approach to be able to mount in the remaining available space. Prior to this invention, incandescent or LED indicators were mounted to the grid by snap-in modules that typically occupied a complete tile space. In the case of metal or phenolic panels, lamp carriers have to be attached by screws or clip assemblies screwed to the back of the panel. These methods occupied valuable panel space and did not permit maximizing the use of available front panel space. Indicator lamps, in the case of LEDs, were wired as permanent assemblies requiring the replacement of the entire module if an LED burned out. In other cases, the LED or incandescent lamp assemblies were available in telephone slide bases, but could only be replaced from behind the panel. An aspect of this invention will show three LED mounting assembly embodiment, by way of example, that provide for front panel replacement of individual LEDs.

Figure 11A:
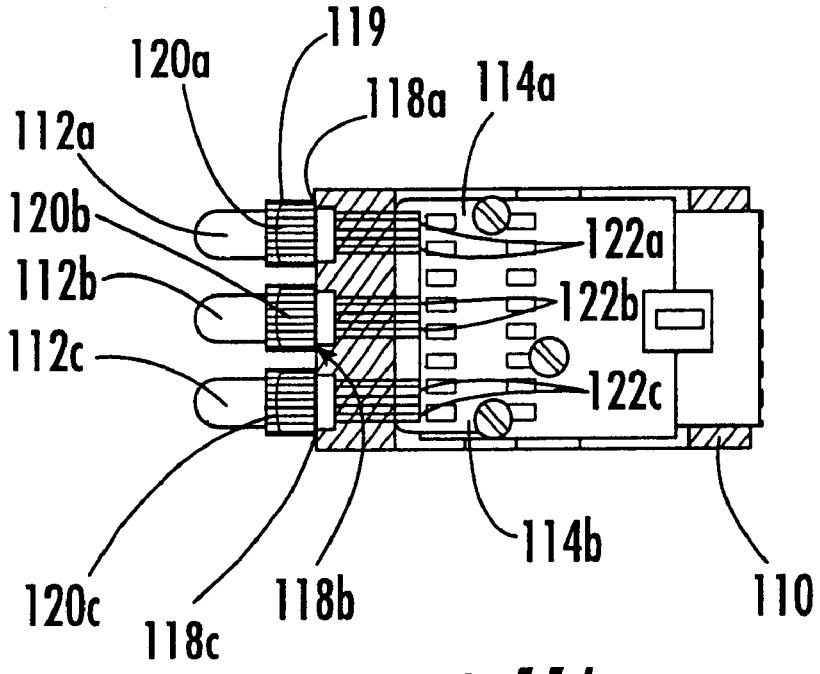
FIG. 11A is a plan view of an LED carrier with LEDs in accordance with the invention.
Figure 11B:
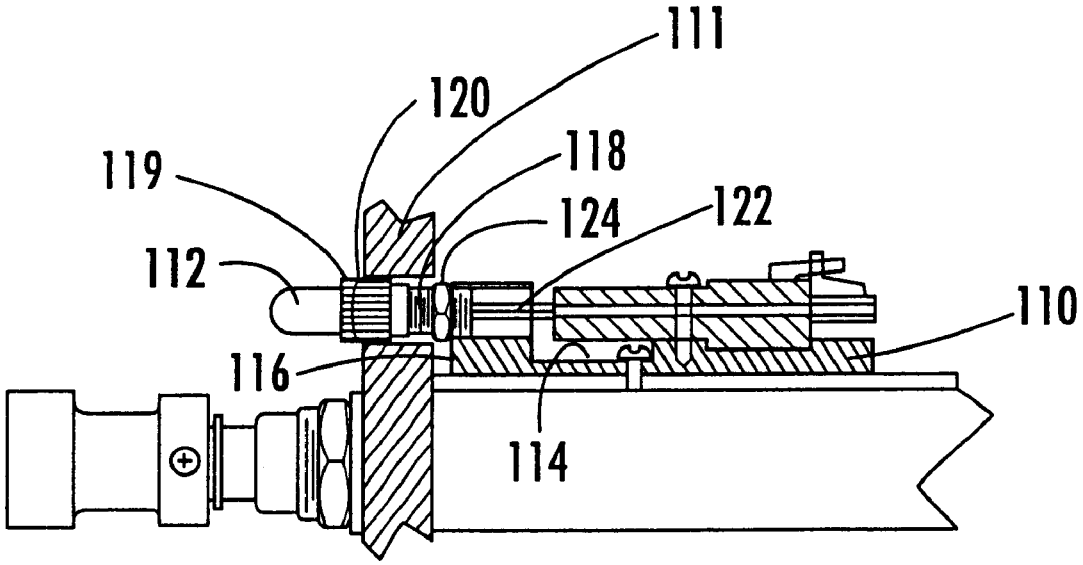
FIG. 11B shows the LED carrier of FIG. 11A as attached to a switch assembly of the invention.

As illustrated with reference to FIGS. 11A and 11B, one embodiment includes a special adjustable low profile LED carrier 110 that will accept 1, 2 or 3 LEDs 112*a*–112*c* either of the Ti or Ti ¾ size. The carrier 110 is designed to nest a particular manufacturer's connector but could be easily altered to use connectors from several other manufacturers. The carrier has two slots 114*a*, 114*b* on either side that allow linear adjustment. This permits either use with panels 111 of various thickness' and the option of front or rear panel LED replacement. The carrier 110 has a vertical section 116 with 1, 2 or 3 threaded holes 118*a*–118*c*, positioned side by side, that will accept up to three cylindrical threaded plastic bases 120*a*–120*c*. Each base 120 has two metal sockets 122*a*–122*c* positioned to accept the LED leads. The side of the base 120 has a polarity indicator to identify which socket 122 is to be used for the cathode lead. The base position can be adjusted by how far the base 120 is screwed into the carrier 110. A portion of the threaded base is left exposed so a cap 119 can be assembled after the. LED is inserted in the base. The base 120 has a nut 124 threaded down to the carrier 110 or plates 111 to insure the base stays in the proper position and resists any base movement when the cap is unscrewed. The cap secures the LED to the base.

Figure 11C:
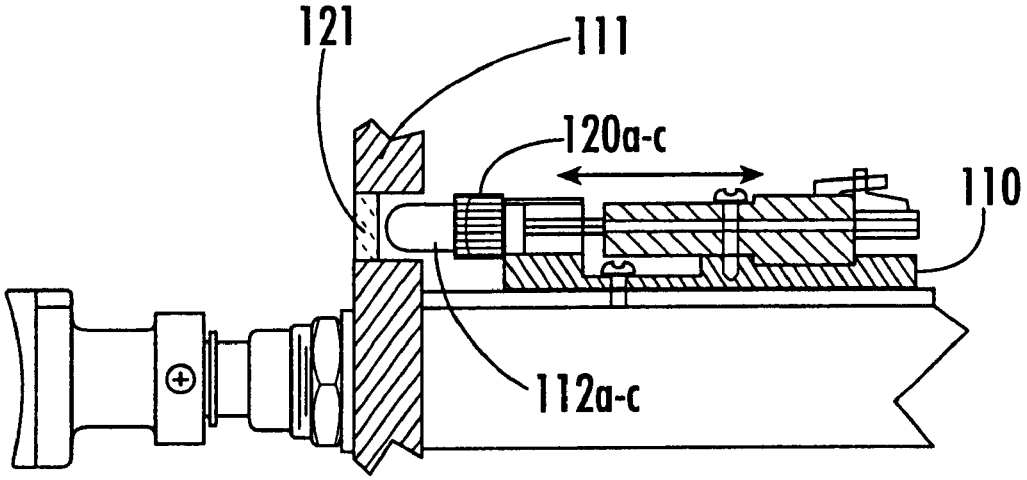
FIGS. 11C and 11D show alternative embodiments of switch assemblies incorporating LED carriers in accordance with the invention.
Figure 11D:
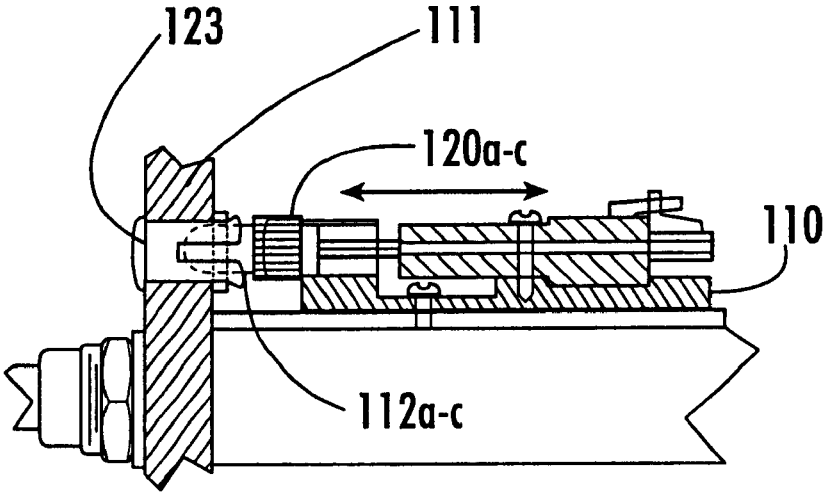

In panel mounted devices the hole 118 for the indicator light 112 can be large enough to allow the cap 119 to partially extend through the panel 111 (this is the case in FIG. 11B), allowing enough finger access to unscrew it. Thus, by adjustment of the carrier 110 or plate position, and the threaded base position, the LED assembly can be moved to account for a range of panel thicknes'and also allow for easy front panel or behind panel LED positioning and replacement. To illustrate examples of LED assemblies having alternative carrier and/or base positioning, FIGS. 11C and 11D are provided. For purposes of description, the FIGS. 11C and 11D embodiments are taken to be three LED assembly embodiments like that of FIGS. 11A and 11B. However, it should be noted that the invention is not limited to the three LED type embodiments, and embodiments such as those including 1 or 4 LEDs may be constructed in accordance with the invention.

In the FIG. 11C configuration, carrier 110 and/or bases 120*a*–*c* have been positioned such that LEDs 112*a*–*c* are located behind the front panel 111. In addition, in the FIG. 11C configuration rectangular press in lenses (e.g. lens 121) are installed in the panel 111 to operate in conjunction with the LEDs 112. The FIG. 11D configuration is similar to the FIG. 11C configuration with the exception that round lenses (e.g. lens 123) are installed in the panel 111 to operate in conjunction with the LEDs 112.

Figure 12A:
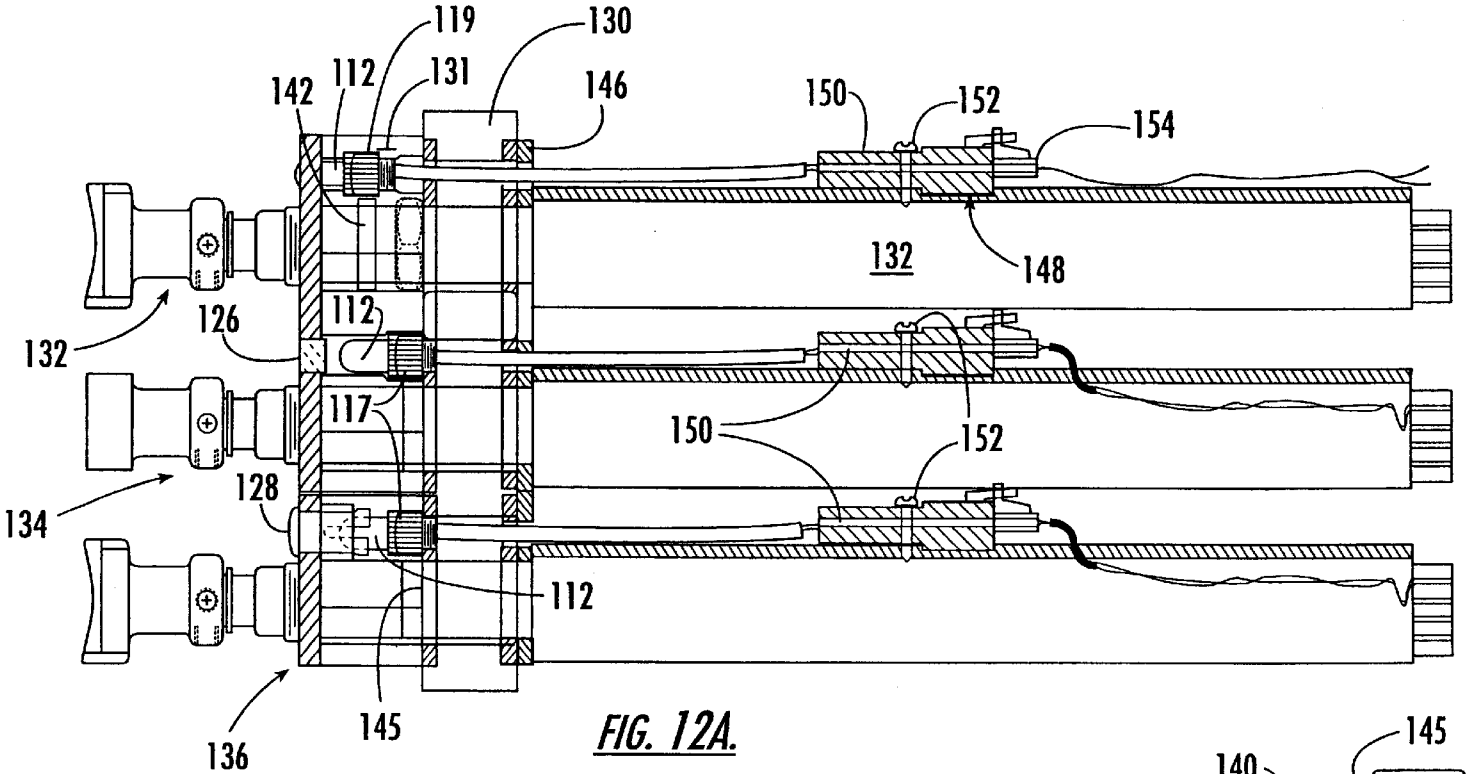
FIG. 12A shows three different types of switch assemblies and their respective grid connections in accordance with a control grid of the present invention.
Figure 12B:
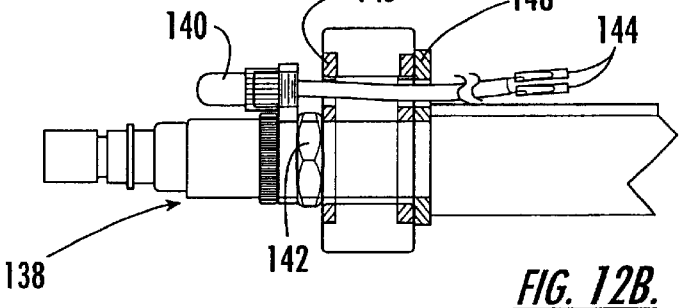
FIG. 12B is a detailed illustration of a grid mounted switch assembly of the invention.

Illumination with respect to grid and tile systems 130 will now be discussed with reference to FIGS. 12A and 12B; wherein FIG. 12A depicts three different types 132, 134 and 136 of switch assemblies installed within a single grid system 130, and FIG. 12B shows a detailed section of a grid mounted assembly 138 with a protruding LED 140. In the case of grid and tile systems 130, the base and socket assembly instead of the carrier assembly is used. However, two different plates are used to position the LEDs depending on the total thickness of the particular grid system being used and whether the LED is to protrude through the tile or remain behind the tile and illuminate a lens (e.g. lens 126 or 128 of FIG. 12A). If the LEDs are to protrude through the tile which allows the tips of the LEDs to be uncovered, a threaded bracket 131 is used to mount up to three T1 or T1 ¾ size LEDs. The bracket 131 is designed to properly position the LEDs to fit within one typically 24–25 mm grid space. It is designed to have the LEDs positioned at the factory specifically for the particular manufacturer's grid 130 and the indicator appearance specified by the customer.

After the switch assembly is mounted and secured to the grid 130 with grid plates 145, a nut and lockwasher, the plate 146 is slid over the shaft and bushing and secured in position with another nut 142. The insulated leads 144 (FIG. 12B) attached to each base have been terminated with male connector pins. The leads fit through holes provided in the back grid plate 146 (FIG. 12A) that secures the controller switch to the grid assembly. The lid 13 or cover of the switch assembly has a narrow channel 148 cut in its surface to accept the LED connector 150 and align it to the switch assembly. The connector 150 is further secured to the switch lid 13 with a small screw 152 that prevents any movement. The lead wires from the LEDs are inserted in the proper holes in the male connector side and the connector is then secured to the switch lid 13. The wire harness with the mating female connector 154 can then be connected to the male, completing the wiring connections. Finally, the front tile is assembled, completing the system graphics.

LEDs and tiles are generally replaced only if graphics and panel functions are changed or LEDs burn out. In either case, it is a simple matter to remove the tile 130, unscrew the LED cap 119 and replace the LED 112 without having to access the rear of the grid/tile 130. Should a section of grid 130 be re-configured to the extent that both switch assembly and LED assembly are not required, again they are easily moved. The o tile is removed, the nut holding the LED plate is removed. The screw holding the connector to the lid is removed and the connector slides forward enough for the LED plate to clear the front of the operating shaft. The switch mounting nut is removed, allowing the switch to be pulled out from the rear of the grid. The LED plate or LED grid plate can then be removed through the rear of the grid assembly. All parts can then be reused in another section of the grid.

In an alternate embodiment herein discussed in connection with FIGS. 13A–13D a replaceable LED is carried directly in the end of the operating shaft. Earlier controller switches could only offer a permanent LED which was epoxied into place. When the LED burned out, the entire switch had to be replaced. They had to be returned to the factory and the repair was very expensive.

Figure 13A:
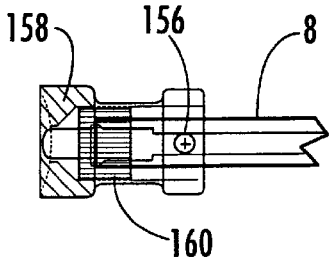
FIG. 13A shows an LED indicator incorporated into the shaft of a switch assembly according to the invention, the LED indicator being easily replaceable from the front of a panel in which the switch assembly is incorporated.
Figure 13B:
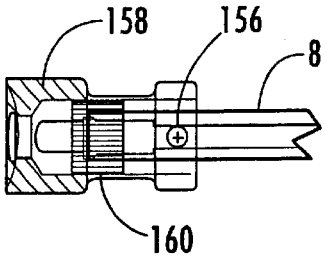
FIG. 13B shows an alternative technique for incorporating an LED indicator into the shaft of a switch assembly according to the invention, the LED indicator being easily replaceable from the front of a panel in which the switch assembly is incorporated.

By providing a screw-in base with sockets that can fit within the controller switch operational shaft customers can now easily change illumination colors or replace damaged or burned out indicators. Referring to FIGS. 13A, two set screws (only one set screw, 156, is shown) holding the knob to the shaft are loosened and the operating knob 158 is removed. The screw on cap 160 that holds the LED to the base is removed and the LED is replaced. The entire operation can be done in seconds from the front of the panel or grid and tile, a major advancement that allowing designers unmatched maximization of panel density. As an alternative, knobs can be supplied with the LED slightly recessed (as in FIG. 13B) so that a lens may be used to cover the tip of the LED, or with just the tip of the LED protruding (as in FIG. 13C).

Figure 13C:
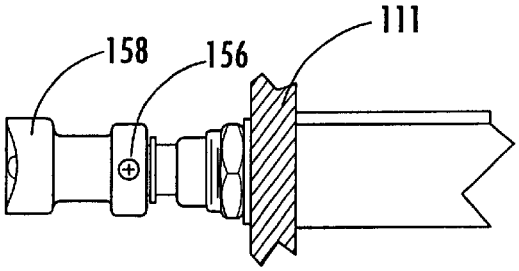
FIG. 13C shows an another alternative technique for incorporating an LED indicator into the shaft of a switch assembly according to the invention.
Figure 13D:
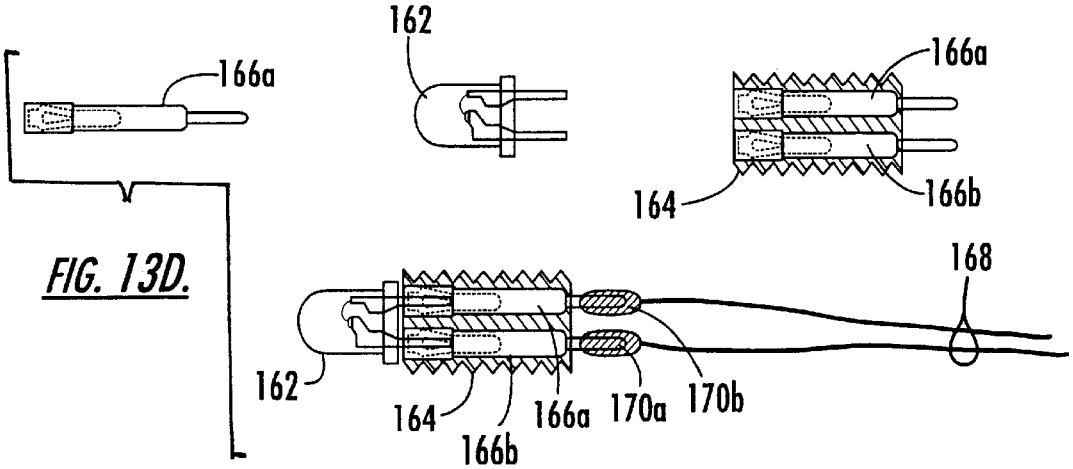
FIGS. 13D–13H illustrate an LED incorporated into the shaft of a switch assembly according to the invention.
Figure 13E:
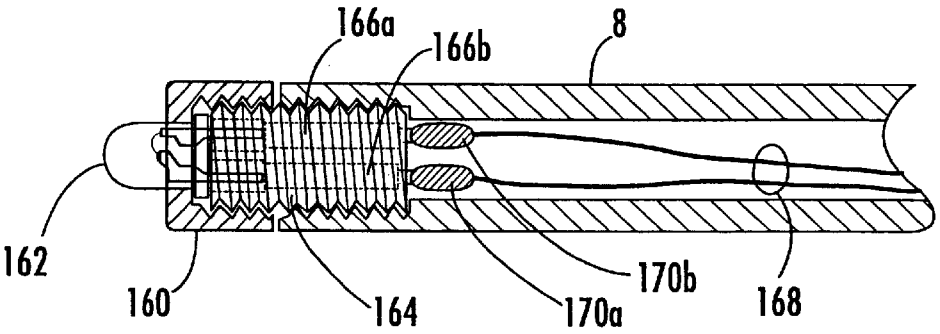
Figure 13F:
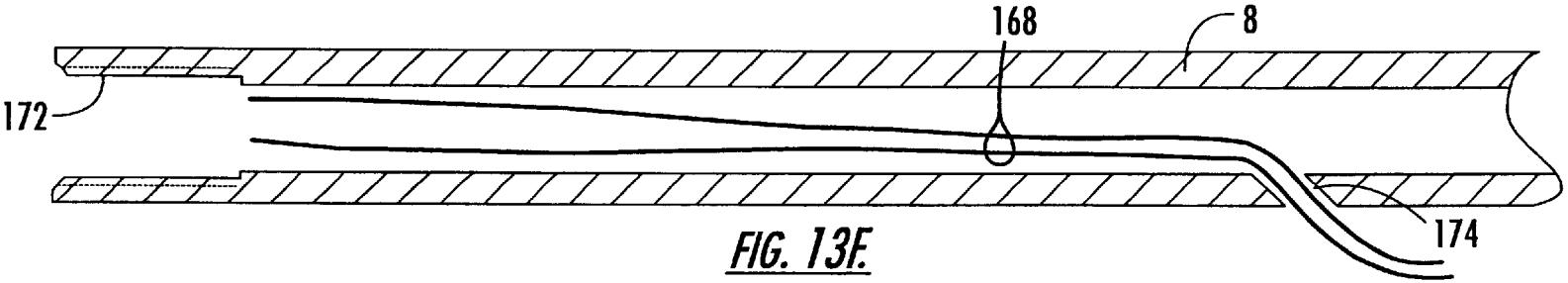
Figure 13H:
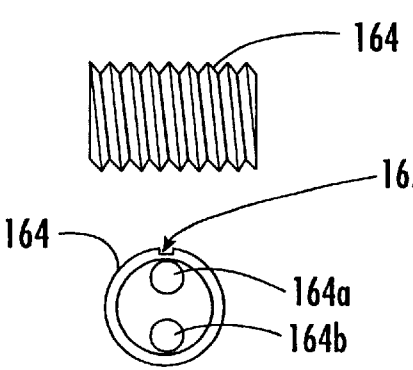
Figure 13G:
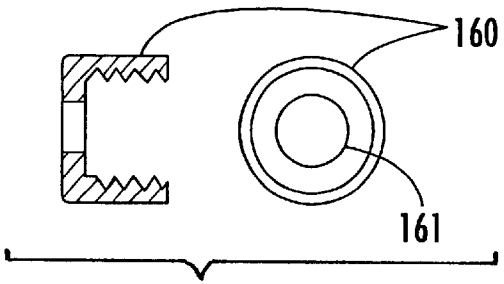

FIG. 13D details an exemplary embodiment of a shaft mounted replaceable LED in accordance with the invention. Part A of FIG. 13C shows a completed shaft/LED sub-assembly. As can be seen from part A, the sub-assembly includes an LED 162, an LED base 164, screw on cap 160, socket pins 166*a* and 166*b*, LED wire leads 168, insulation 170*a* and 170*b* for the LED leads and shaft 8. The LED base can be threaded as shown, or can be formed with a partially smooth outer surface to allow for a "press-fit" connection with shaft. As can be seen from Part B, the shaft includes an interior-threaded end 172 to accommodate base 164 and includes an opening 174 along its length to allow the LED leads to pass from the shaft's interior to its exterior where they can be more readily accessed. If a press-fit LED base is used, the shaft end 172 would be smooth to accommodate the smooth portion of the base. Part C shows front and side views of screw in base 164, and part D shows front and side views of screw on cap 160. As can be seen from part C, the screw in base includes two holes 164*a* and 164*b* to accommodate the socket pins and a notch 165 which serves as an LED polarity indicator. As can be seen from part D, the screw on cap includes a through hole 161 to accommodate LED 162. Part E shows how the LED, socket pins, base, leads and insulation fit together. As can be seen from part E, the socket pins are inserted into the base and the LED is, in turn, inserted into the socket pins. Electrical coupling to the LED is achieved through the socket pins by connecting the LED leads to the pins, the leads and pins being joined, for example, by heat shrink insulation tubing 170*a* and 170*b*.

When designers only need a single LED indicator, a completely enclosed switch assembly with a front panel replaceable indicator and totally enclosed wiring allows stacking and front panel savings of up to 70% over other products. When they need multiple indication capability, they can use the light in the knob plus the 3 light array on top of the enclosure. All of this indication can be done within a 0.950 inch square area.

Figure 14A:
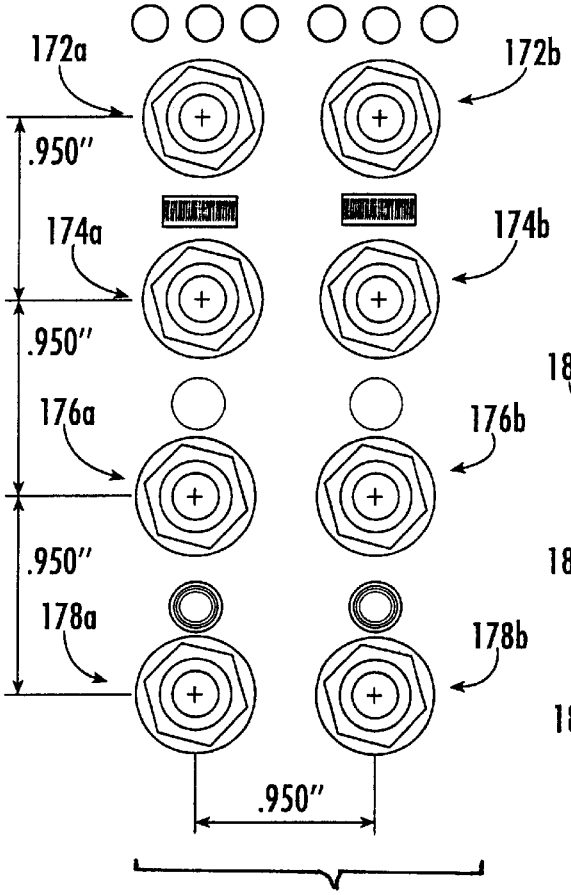
FIGS. 14A, 14B and 15 show various types of illumination layouts which can be realized with the switch assemblies of the invention.
Figure 14B:
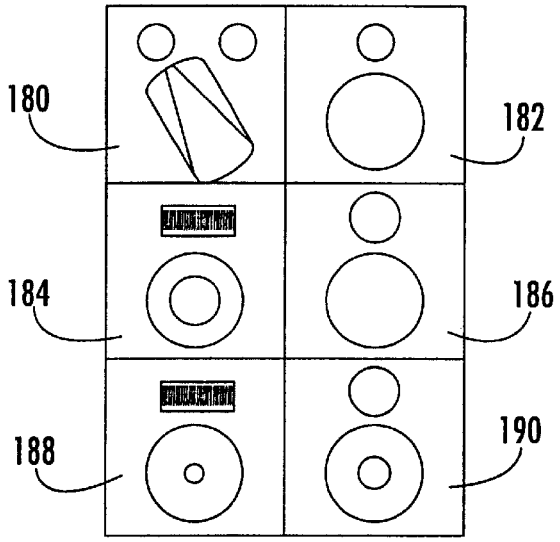

FIGS. 14A and 14B show various types of illumination layouts which can be achieved with the present invention, as well as showing how switches incorporating such layouts can be incorporated into grid and tile systems. FIG. 14A shows a 4×2 grid of switch assemblies, wherein each assembly occupies a 0.950 inch square area of the grid (the knobs of the switches are not shown for clarity of presentation). Assemblies 172*a* and 172*b* each have three LEDs, and are of the type where the tips of the LEDs protrude from the grid panel (see e.g. FIG. 12A, assembly 132). Assemblies 174*a* and 174*b* each have one LED, and are of the type where the tip of the LED is positioned behind the panel and the panel includes a rectangular lens for operation with the LED (see e.g. FIG. 12A, assembly 134). Assemblies 176*a* and 176*b* each have one LED, and are of the type where the tip of the LED is positioned behind the panel and the panel includes a round lens for operation with the LED (see e.g. FIG. 12A, assembly 136). Assemblies 178*a* and 178*b* each have one LED, and are of the type where the tip of the LED protrudes from the grid panel and the LED is front panel replaceable (see e.g. FIG. 11B).

FIG. 14B illustrates a 3×2 grid of switch assemblies wherein the switch knobs are shown. As can be seen from FIG. 14B, assembly 180 includes two protruding type LEDs mounted above an "arrow" knob. Assembly 182 includes a protruding LED mounted above a round knob. Assembly 184 includes a first LED mounted above a round knob and behind the front panel, and a second LED mounted in the center of the knob and behind the knob face, a rectangular lens being positioned in the panel for operation with the first LED and a round lens being positioned in the knob face for operation with the second LED (see e.g. FIG. 13B). Assembly 186 includes an LED mounted above a round knob and behind the front panel with a round lens being positioned in the panel for operation with the LED. Assembly 188 includes a first LED mounted above a round knob and behind the front panel, and a second LED mounted in the center of the knob and protruding from the knob face (see e.g. FIG. 13C), a rectangular lens being positioned in the panel for operation with the first LED. Assembly 190 includes a first LED mounted above a round knob and behind the front panel, and a second LED mounted in the center of the knob, a round lens being positioned in the panel for operation with the first LED and the second LED being positioned for easy front panel replacement (see e.g. FIG. 13A).

Figure 15:
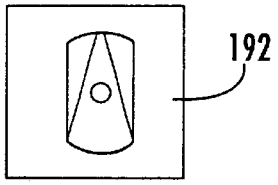

FIG. 15 shows an additional switch assembly 192 suitable for use in a grid system according to the present invention. The assembly of FIG. 15 includes an LED mounted in the center of an arrow knob and protruding from the knob face.

Figure 16:
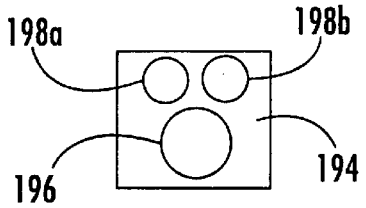
FIG. 16 shows an alternative grid plate suitable for use with a switch assembly of the invention.

FIG. 16 shows an exemplary grid plate 194 which can be used in a grid system such as that depicted in FIG. 14B. The depicted grid plate includes a through hole 196 for a switch assembly shaft, and two through holes 198*a* and 198*b* to accommodate LEDs protruding from a front panel. The grid plate of FIG. 16 can be used, for example, with switch assembly 180 of FIG. 14B.

Figure 17:
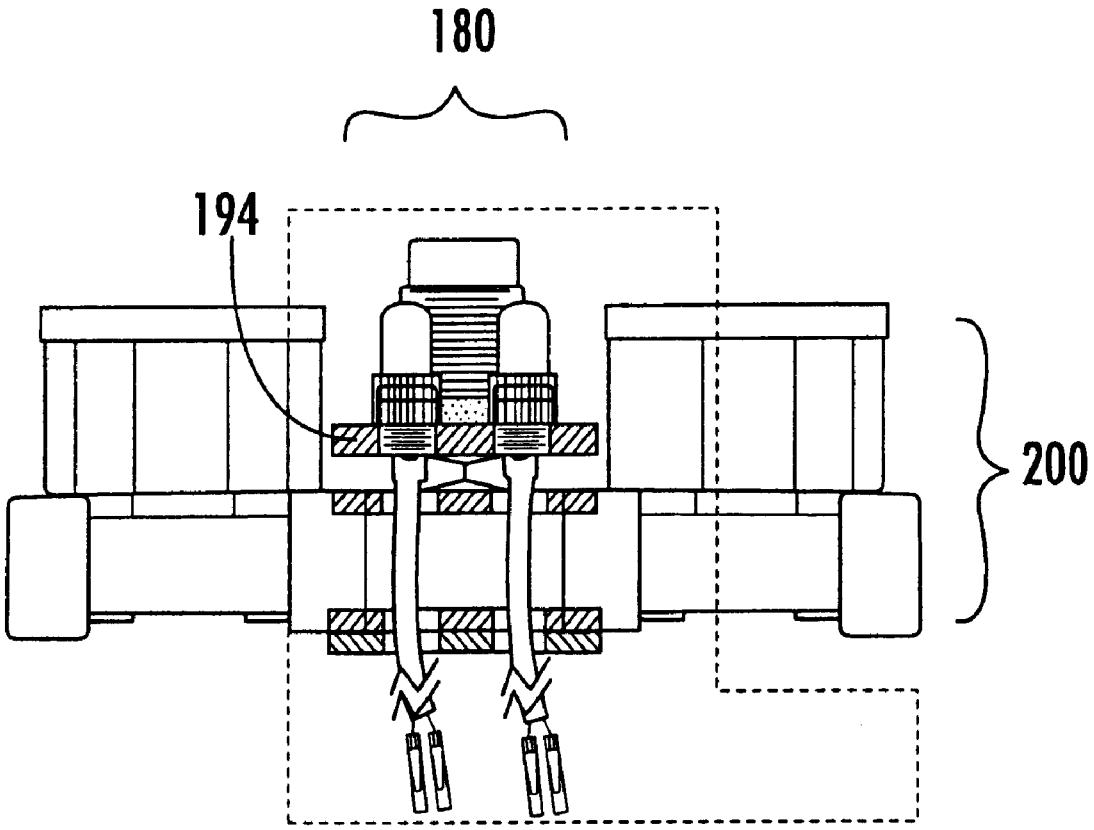
FIG. 17 shows a top view of a switch assembly mounted in a grid according to the invention.

FIG. 17 is a top view of switch assembly 180 as the assembly is mounted in a grid 200. As shown in FIG. 17, and as mentioned above in relation to FIG. 16, grid plate 194 is suitable for mounting assembly 180 in the grid. The knob of assembly 180 is not shown in FIG. 17.

Two of many possible methods of connecting the switch assemblies of the present invention to various control equipment are shown in part X of FIG. 4. The design is flexible to allow for a male/female connector assembly 162, single cable or double cable connections. In the case of the plug and receptacle connector assembly, the rear of the enclosure is designed to accept up to 15 pins of #22 GA. Wire. With reduced current requirements and/or smaller gauge wire, we can increase the number of pins (circuits ) to 24 for an integral connector within the 0.950" wide × 0.640" high foot print. The female portion of the connector is designed to "drop-in" to a nest in the rear of the housing. With the final assembly of the lid, the connector is fully trapped and cannot be pulled out.

When cables or individual wires are used, the bottom rear of the housing is designed to nest either one 164 or two grommets 166 that are sized to the diameter of the cable/cables being brought into the rear of the switch. A single 168 or double 170 clamping bar is then tightened using two screws 172 for the single and one screw 174 for the double. The screws thread into the base, compressing the grommet/grommets for secure wire retention. The switch lid is then assembled. The lid covers the clamping plate screws preventing any possibility of a "backing out" situation due to vibration inherent in many locations using these switches. The end of the cable not connected directly to the switch can then be terminated with another connector or at a terminal junction strip located somewhere else in the control console.

Another feature of our wire termination design is that we retain the ability to easily manufacture the enclosures out of various materials and process. As mentioned earlier, the enclosures can be machined out of metal or plastic. With simple inserts in the tooling for the rear cable/connector section, the parts can be either injection molded of metal or plastic, or fabricated using a zinc diecast method. Inserts can also be used for alterations in the push-pull or turn switch pockets to accommodate a variety of snap-switch modules available from different manufacturers. These features prevent being locked into a position of having to rely on a sole supplier for critical functional components used in these switch assemblies.

The designs of other manufacturers using cams to operate switch modules, generally have mechanisms that constantly force the operating button to "bottom out" at the maximum of the travel limit and manufacturers of snap-switch modules advise this will reduce the mechanical operating life of their products. Our invention insures that we get the maximum mechanical life these products were designed to provide. In addition, the nature of the basic enclosure design of other manufacturers allows them to easily twist or distort after being mounted in a panel or grid and tile system. This is generally caused by the forces exerted by cables or bundles of cables attached to groups of controls mounted in close proximity. The distortion due to these forces can inhibit operating shaft motion and, therefore, affect switch performance. The invention's controller switch case design is significantly more durable and capable of much harsher handling without loss in performance.

While the present invention has been particularly shown and described in conjunction with preferred embodiments thereof, it will be readily appreciated by those of ordinary skill in the art that various changes may be made without departing from the spirit and scope of the invention. Therefore, it is intended that the appended claims be interpreted as including the embodiments described herein as well as all equivalents thereto.

That which is claimed is:

1. A switch assembly comprising:

a housing;

a switching module carried by the housing, the switching module having a button operable therewith for activation thereof;

a shaft carried by the housing, the shaft having a proximal end outside the housing for manual operation by a user, and a distal end within the housing, the shaft mounted for longitudinal movement along an axis thereof and rotational movement about the axis;

a shaft bearing secured to the housing and slidably receiving the shaft therein for longitudinal and rotational movement thereof, the shaft bearing having a slot therein for defining at least one of an axial and a longitudinal range of movement, the shaft further having a shaft pin extending therefrom for engaging the slot to thus restrict the movement of the shaft;

a disk carried by the shaft at a distal end thereof, the disk positioned for movement from a shaft neutral position wherein the disk is in a spaced position to the button of the switching module to a contacting position resulting from movement of the shaft for activation of the switching module;

spring means operable with the shaft for biasing the shaft to the neutral position and automatically returning the shaft thereto from any radially and longitudinally displaced position, the spring means comprising a torsion spring operable with the shaft for biasing the rotational movement thereof to the neutral position; and a shoe slidably carried by the housing for only longitudinal sliding movement of the shoe within the housing through a frictional contact therewith, the shoe operable with the torsion spring for the biasing thereof while preventing frictional contact of the torsion spring with the housing.

2. A switch assembly according to claim 1, wherein the housing comprises a rectangular shaped cross-section and a lid removable therefrom for providing access into the housing.

3. A switch assembly according to claim 1, wherein the switching module is fixedly carried within the housing.

4. A switch assembly according to claim 1, wherein the switching module comprises at least first and second switching modules positioned for operation thereof by the disk.

5. A switch assembly according to claim 4, wherein the at least first and second switching modules are longitudinally displaced from each other for operation by the disk in one of a pulling motion of the shaft and a pushing motion of the shaft, the pulling motion activating the first switching module and the pushing motion activating the second switching module.

6. A switch assembly according to claim 1, wherein the slot is defined by at least one of a longitudinal slot portion and a radial slot portion, and wherein the longitudinal slot portion limits th e of longitudinal motion of the shaft and thus the disk, and the radial slot portion limits the range of radial motion of the shaft and thus the disk.

7. A switch module according to claim 6, wherein the shaft bearing is slidable into and out of the housing for removably affixing therein for permitting a changing of shaft bearings having a preselected desirable arrangement of longitudinal and radial slot portions.

8. A switch assembly according to claim 1, wherein the disk is selected form a group of disks having one of no perimeter breaks, at least one perimeter break, and a plurality of perimeter breaks.

9. A switch assembly according to claim 1, wherein the disk is carried at an extremity of the shaft distal end.

10. A switch assembly according to claim 1, wherein the disk is carried at an intermediate location on the shaft within the housing.

11. A switch assembly according to claim 1, wherein at least four switching modules are carried within the housing and wherein only one disk is positioned for operation with the at least four of the switching modules.

12. A switch assembly according to claim 1, wherein at least six switching modules are carried within the housing and wherein first and second disks are carried by the shaft and positioned for operation with the at least six switching modules.

13. A switch module according to claim 1, wherein the shoe comprises a collar for retaining the torsion spring and a pin operable with end portions of the torsion spring for providing a stop to which each end of the spring operates during rotational operation of the shaft.

14. A switch assembly according to claim 2, wherein the switching module comprises a plurality of switching modules positioned for operation by the disk.

15. A switch assembly according to claim 14, wherein at least first and second switching modules are longitudinally displaced from each other for operation by the disk in one of a pulling motion of the shaft and a pushing motion of the shaft, the pulling motion activating the first switching module and the pushing motion activating the second switching module.

16. A switch assembly comprising:

a housing;

a switching module carried by the housing;

a shaft slidably carried by the housing;

a shaft bearing secured to the housing and slidably receiving the shaft therein for longitudinal and rotational movement thereof, the shaft bearing having a slot therein for defining at least one of an axial and a longitudinal range of movement, the shaft engaging the sotto thus restrict the movement thereof; and a disk carried by the shat positioned for movement from a shaft neutral position, wherein the disk is in a spaced relation to the switching module to a contacting position resulting from movement of the shaft for activation of the switching module.

17. A switch assembly according to claim 16, further comprising a shaft pin fixedly attached to the shaft and radially extending therefrom, the shaft pin slidable within the slot for limited movement thereof and thus providing the limited movement of the shaft.

18. A switch assembly according to claim 16, further comprising:

spring means operable with the shaft for biasing the shaft to the neutral position and automatically returning the shaft thereto from any radially and longitudinally displaced position, the spring means comprising a torsion spring operable with the shaft for biasing the rotational movement thereof to the neutral position; and a shoe slidably carried by the housing for only longitudinal sliding movement of the shoe within the housing through a frictional contact therewith, the shoe operable with the torsion spring for the biasing thereof while preventing frictional contact of the torsion spring with the housing.

19. A switch assembly according to claim 16, wherein the switching module is fixedly carried within the housing.

20. A switch assembly according to claim 16, wherein the slot is defined by at least one of a longitudinal slot portion and a radial slot portion, and wherein the longitudinal slot portion limits the range of longitudinal motion of the shaft and thus the disk, and the radial slot portion limits the range of radial motion of the shaft and thus the disk.

21. A switch module according to claim 20, wherein the shaft bearing is slidable into and out of the housing for removably affixing therein for permitting a changing of shaft bearings having a preselected desirable arrangement of longitudinal and radial slot portions.

22. A switch assembly according to claim 16, wherein the disk is selected form a group of disks having one of no perimeter breaks, at least one perimeter break, and a plurality of perimeter breaks.

23. A switch assembly according to claim 16, wherein at least four switching modules are carried within the housing and wherein only one disk is positioned for operation with the at least four of the switching modules.

24. A switch assembly according to claim 16, wherein at least six switching modules are carried within the housing and wherein first and second disks are carried by the shaft and positioned for operation with the at least six switching modules.

25. A switch assembly comprising:

a housing;

a switching module carried by the housing;

a shaft slidably carried by the housing;

a torsion spring operable with the shaft for biasing the shaft to a neutral position and automatically returning the shaft thereto from any radially displaced position; and a shoe slidably carried by the housing for only longitudinal sliding movement of the shoe within the housing through a frictional contact therewith, the shoe operable with the torsion spring for the biasing thereof while preventing frictional contact of the torsion spring with the housing.

26. A switch assembly according to claim 25, further comprising a shaft bearing secured to the housing and slidably receiving the shaft therein for longitudinal and rotational movement thereof, the shaft bearing having a slot therein for defining at least one of an axial and a longitudinal range of movement, the shaft engaging the slot to thus restrict the movement thereof.

27. A switch assembly according to claim 25, further comprising a disk carried by the shaft and positioned for movement from a shaft neutral position, wherein the disk is in a spaced relation to the switching module, to a contacting position resulting from movement of the shaft for activation of the switching module.

28. A switch module according to claim 25, wherein the shoe comprises a collar for retaining the torsion spring and a stop operable with end portions of the torsion spring for biasing each end of the spring when operated during rotational operation of the shaft.

29. A switch assembly according to claim 25, wherein the housing and the shoe comprise rectangular shaped cross-sections for operating to prevent rotation of the shoe within the housing.

30. A switch assembly according to claim 25, further comprising a compression ring operable with the shaft for biasing the shaft to the neutral position.

* * * * *